US007282868B2

(12) United States Patent
Ushijima et al.

(10) Patent No.: US 7,282,868 B2
(45) Date of Patent: Oct. 16, 2007

(54) INVERTER CIRCUIT FOR DISCHARGE LAMPS FOR MULTI-LAMP LIGHTING AND SURFACE LIGHT SOURCE SYSTEM

(75) Inventors: Masakazu Ushijima, 30-24 Nogata 6-chome, Nakano-ku, Tokyo (JP) 165-0027; Koji Kawamoto, Tajimi (JP); Youichi Yamamoto, Tottori (JP); Minoru Kijima, Ota (JP)

(73) Assignees: Masakazu Ushijima, Tokyo (JP); Hong-Fei Chen, Taichung (TW)

( * ) Notice: Subject to any disclaimer, the term of this patent is extended or adjusted under 35 U.S.C. 154(b) by 0 days.

(21) Appl. No.: 10/773,230

(22) Filed: Feb. 9, 2004

(65) Prior Publication Data

US 2004/0155596 A1 Aug. 12, 2004

(30) Foreign Application Priority Data

Feb. 10, 2003 (JP) ..... 2003-031808
Apr. 15, 2003 (JP) ..... 2003-109811
Jan. 9, 2004 (JP) ..... 2004-003740

(51) Int. Cl.
*H05B 41/24* (2006.01)

(52) U.S. Cl. ..... 315/277; 315/276; 315/291; 315/312; 345/102

(58) Field of Classification Search ..... 315/276–278, 315/274, 282, 312, 291, DIG. 2, 224, 119; 345/102, 87, 84, 55, 30; 349/70, 61, 56
See application file for complete search history.

(56) References Cited

U.S. PATENT DOCUMENTS 4,016,477 A * 4/1977 Ghiringhelli ..... 315/257
4,572,990 A 2/1986 Leale et al. ..... 315/220
6,226,196 B1 5/2001 Toshinari et al.
6,310,444 B1 10/2001 Chang ..... 315/282
6,323,602 B1 * 11/2001 De Groot et al. ..... 315/276
6,459,216 B1 10/2002 Tsai et al.
6,717,371 B2 * 4/2004 Klier et al. ..... 315/274
6,717,372 B2 * 4/2004 Lin et al. ..... 315/276
2002/0125838 A1 9/2002 Hsien
2002/0140538 A1 10/2002 Yer et al. ..... 336/198

(Continued)

FOREIGN PATENT DOCUMENTS

CN 521947 A 12/2001

(Continued)

*Primary Examiner*—Douglas W. Owens
*Assistant Examiner*—Ephrem Alemu
(74) *Attorney, Agent, or Firm*—Birch, Stewart, Kolasch & Birch, LLP

(57) ABSTRACT

An inverter circuit for discharge lamps for multi-lamp lighting in which the value of a negative resistance characteristic of a fluorescent lamp is controlled, and an excessively set reactance is eliminated by causing a shunt transformer to have a reactance exceeding the negative resistance characteristic. Two coils connected to a secondary winding of a step-up transformer of the inverter circuit are arranged and magnetically coupled to each other to form a shunt transformer for shunting current such that magnetic fluxes generated thereby cancel each other out. Discharge lamps are connected to the coils, respectively, with currents flowing therethrough being balanced. Each discharge lamp is lighted because a reactance of an inductance related to the balancing operation which is in an operating frequency of the inverter circuit, exceeds a negative resistance of discharge lamps.

6 Claims, 18 Drawing Sheets

U.S. PATENT DOCUMENTS

| | | | | |
|---|---|---|---|---|
| 2003/0001524 | A1 | 1/2003 | Lin et al. | 315/312 |
| 2003/0137222 | A1* | 7/2003 | Takeda et al. | 310/359 |
| 2003/0141829 | A1 | 7/2003 | Yu et al. | 315/312 |
| 2004/0183448 | A1 | 9/2004 | Hsueh et al. | 315/57 |
| 2005/0093471 | A1 | 5/2005 | Jin | 315/246 |
| 2005/0093472 | A1 | 5/2005 | Jin | 315/246 |
| 2005/0218827 | A1 | 10/2005 | Ushijima et al. | 315/224 |

FOREIGN PATENT DOCUMENTS

| | | | |
|---|---|---|---|
| EP | 0 766 500 | A1 | 4/1997 |
| EP | 0 910 229 | A2 | 4/1999 |
| EP | 0 910 229 | A3 | 8/1999 |
| EP | 1 397 028 | A1 | 3/2004 |
| JP | 56-54792 | A | 5/1981 |
| JP | 59-108297 | A | 6/1984 |
| JP | 63-105498 | | 10/1988 |
| JP | 01 031394 | A | 2/1989 |
| JP | 2-117098 | A | 5/1990 |
| JP | 07 045393 | A | 2/1995 |
| JP | 2727461 | B2 | 12/1997 |
| JP | 2727462 | B2 | 12/1997 |
| JP | 2733817 | B2 | 1/1998 |
| JP | 11 238589 | A | 8/1999 |
| JP | 2002-164193 | A | 6/2002 |
| JP | 2005-317253 | A | 11/2005 |
| TW | 478292 | | 3/2002 |
| TW | 521-947-Y | A1 | 2/2003 |
| TW | 594 808-B | A1 | 6/2004 |

* cited by examiner

VOLTAGE-CURRENT CHARACTERISTIC OF COLD-CATHODE FLUORESCENT LAMP (CCFL)

VOLTAGE-CURRENT CHARACTERISTIC OF COLD-CATHODE FLUORESCENT LAMP (CCFL)

WINDING METHOD OF S WINDING GUARANTEES LINE-TO-LINE WITHSTAND VOLTAGE BY WINDING ONE ELECTRIC WIRE UPON ANOTHER IN A DIAGONALLY STACKED MANNER AS ILLUSTRATED ABOVE.

INVERTER CIRCUIT FOR DISCHARGE LAMPS FOR MULTI-LAMP LIGHTING AND SURFACE LIGHT SOURCE SYSTEM

This application claims priority to Japanese Patent Application Nos. 2003-31808 filed on Feb. 10, 2003, 2003-109811 filed on Apr. 15, 2003 and 2004-003740 filed on Jan. 9, 2004.

TECHNICAL FIELD

This invention relates to an inverter circuit for discharge lamps, such as cold-cathode fluorescent lamps and neon lamps, and more particularly to an inverter circuit for discharge lamps for multi-lamp lighting, which includes current-balancing transformers for lighting a large number of discharge lamps, and a surface light source system.

BACKGROUND OF THE INVENTION

Recently, backlights for liquid crystal displays have been increased in size, and with the increase in the size of the backlights, a lot of cold-cathode fluorescent lamps have come to be used per each backlight. Also in inverter circuits for liquid crystal display backlights, multi-lamp lighting circuits are used for lighting a large number of cold-cathode fluorescent lamps.

Conventionally, to light a large number of cold-cathode fluorescent lamps, one or a plurality of high-powered step-up transformers are used, as shown in FIG. 16, and the cold-cathode fluorescent lamps are connected to the secondary-side outputs of the step-up transformers via a plurality of capacitive ballasts, whereby the secondary-side outputs of the step-up transformers are shunted to light a lot of cold-cathode fluorescent lamps.

To implement the above construction, there are used two conventional methods: one not utilizing resonance in a secondary circuit, and the other utilizing resonance in the secondary circuit, which is becoming popular in recent years. Although they are not distinguished from each other in a simplified circuit diagram, they are distinguished from each other when described in detail with reference to a transformer equivalent circuit.

FIG. 17 shows another example of the multi-lamp lighting circuit. In the figure, leakage flux step-up transformers are provided for respective cold-cathode fluorescent lamps, and by making use of leakage inductance generated on the secondary side of each step-up transformer, that is, by resonating the leakage inductance and a capacitive component of the secondary circuit, a high conversion efficiency and the effect of reducing heat generation are obtained.

This technique is disclosed by one of the inventors of the present invention in Japanese Patent No. 2733817. In this example, the current flowing through each cold-cathode fluorescent lamp is varied depending on the influence of parasitic capacitance generated, for example, by wiring on the secondary side of a backlight, the aging of the cold-cathode fluorescent lamp, and the manufacturing errors. To stabilize the current, the lamp current of each cold-cathode fluorescent lamp is returned to the control circuit, whereby the output control of the inverter circuit is performed.

Further, there is another technique which does not provide a leakage flux step-up transformer for each of the individual cold-cathode fluorescent lamps, but as shown in FIG. 18 and FIG. 19, provides a plurality of secondary windings with respect to one primary winding to thereby consolidate leakage flux transformers, with a view to reduction of costs.

In addition, as the inverter circuit for a cold-cathode fluorescent lamp, there is a type which uses a piezoelectric transformer other than a winding transformer. In this type of inverter circuit, one cold-cathode fluorescent lamp is generally lighted by one piezoelectric transformer.

On the other hand, when a plurality of hot-cathode lamps are to be lighted by one inverter circuit, the multi-lamp lighting is made possible by using a shunt transformer (so-called a "current balancer") as disclosed in Japanese Laid-Open Patent Publication (Kokai) Nos. Sho 56-54792, Sho 59-108297, and Hei 02-117098. Such a current balancer per se is known in the example of use thereof for lighting hot-cathode lamps. Further, the impedance of hot-cathode lamps is very low, and the discharge voltage thereof is approximately 70 V to several hundreds of volts, which makes it unnecessary to pay much attention to the adverse influence of parasitic capacitance generated around each discharge lamp. Therefore, it is easy to apply the current balancer to the hot-cathode lamps.

Further, in this method, when one of the connected hot-cathode lamps is unlighted, an excessive voltage is generated at a terminal of a current balancer associated with the unlighted hot-cathode lamp, so that when hot-cathode lamps are partially unlighted, there is no other choice but to interrupt the circuit. Accordingly, the current balancer could not be put into practical use as a single device unless several countermeasures to the problem are taken beforehand. Moreover, the current balancer itself was conventionally large in size.

On the other hand, it is considered in principle that the current balancer can be similarly applied to parallel lighting of cold-cathode fluorescent lamps. However, many of the proposals which have been made are unstable, and no example of practical use has appeared for a long time period since the early days of the cold-cathode fluorescent lamp. Further, although the application of the current balancers to cold-cathode fluorescent lamps was experimentally possible, the size of the current balancer was too large for practical use. This is for the following reason:

It is considered that the parallel lighting of cold-cathode fluorescent lamps can be performed, for example, by a circuit configuration shown in FIG. 20. A typical example of disclosure is Republic of China patent No. 521947. In this example, ballast capacitors Cb are arranged in series with respective cold-cathodes DT, for current shunting, and a current balancer Tb is combined with the above arrangement, for obtaining the current-balancing effect.

As represented by the Republic of China patent No. 521947, it has been considered that the reactance of the current balancer is required to have a value well above the impedances Z1 and Z2 of cold-cathode fluorescent lamps, as calculated by the following equation:

Assuming that M represents the mutual inductance between $L_1$ and $L_2$, $L_1=L_2=M$ $$V=(Z_1+j\omega L_1)\cdot j_1-j\omega\cdot M\cdot j_2 \quad (1)$$

$$V=(Z_2+j\omega L_2)\cdot j_2-j\omega\cdot M\cdot j_1 \quad (2)$$

From the above equations 1 and 2, $$\{Z_1+j\omega(L_1+M)\}\cdot j_1-\{Z_2+j\omega(L_2+M)\}\cdot j_2=0$$

$$j_2 = \frac{Z_1 + j\omega(L_1 + M)}{Z_2 + j\omega(L_2 + M)} \cdot j_1 = \frac{Z_1 + 2j\omega \cdot L_1}{Z_2 + 2j\omega \cdot L_1} \cdot j_1 \quad (3)$$

Compared with $Z_1$ and $Z_2$, if $2\omega L$ is sufficiently large, even when $Z_1 \neq Z_2$, $j_1 \approx j_2$.

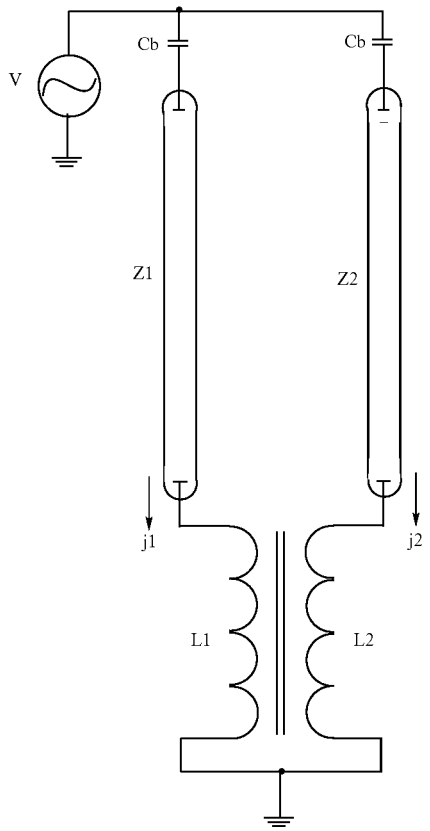

Further, in the case of the circuit configuration shown in FIG. 20, since the major part of the current-shunting effect is entrusted to the ballast capacitors Cb, it is possible to exhibit the current-shunting effect irrespective of the magnitude of the reactance of the current balancer Tb. In this case, the ballast capacitors Cb are essential, and the effect of causing lighting of discharge lamps C is obtained by a combination of a high voltage caused to be generated by a transformer at the immediately preceding stage, and the operation of the ballast capacitors Cb.

Further, in these proposals, the impedances of the cold-cathode fluorescent lamp are regarded as pure resistances based on a theory shown by the above equation and FIG. 20. More specifically, the impedances are determined by the VI characteristic (voltage-current characteristic) of the cold-cathode fluorescent lamp, and regarding the impedances as pure resistances, a reactance sufficiently larger than the impedances of the cold-cathode fluorescent lamp is set, whereby variation in the impedances of the individual cold-cathode fluorescent lamps is corrected.

More specifically, the reactance of the current balancer is set with a view to correction of variation in the impedances of the individual cold-cathode fluorescent lamps. Although it cannot be said that the theory is false, the reactance set as above does not reflect a minimum required reactance value. In this case, since the current balancer is provided for the purpose of correcting variation in the impedances of the individual cold-cathode fluorescent lamps, a considerably large reactance (mutual inductance) is required. Therefore, so long as the inductance is determined based on the theory, an inductance value required for the current balancer has to become excessive, and further, the current balancer inevitably has to be made fairly large in outside dimensions.

Inversely, if the outside dimensions of a current balancer are to be reduced to meet with the market demands, the effective permeability of a core material of the transformer is lowered, so that when the required inductance determined by the above equation is to be secured, the coil has to be formed by a large number of turns of an extra fine wire. However, this results in increased distributed capacitance, thereby causing a decrease in the self-resonance frequency of the current balancer, so that the current balancer loses its reactance. This can lead to degradation of current-balancing capability of the current balancer. As a result, the current balancer cannot properly shunt current so that the imbalance of currents is caused.

Since cold-cathode fluorescent lamps used for a liquid crystal display backlight are discharge lamps, they have a negative resistance characteristic. This characteristic is drastically changed, when the cold-cathode fluorescent lamps are mounted on the liquid crystal display backlight. However, originally, the negative resistance characteristic of each cold-cathode fluorescent lamp in the mounted state is not controlled, and hence e.g. when lots of liquid crystals are changed during mass production, various problems are liable to occur. Moreover, those skilled in the art have almost no recognition concerning the negative resistance characteristic of the liquid crystal display backlight. In view of the above circumstances, when small-sized shunt transformers are used, it has been considered essential to insert shunt capacitors Cb in series by way of precaution have been considered essential, in order to prevent occurrence of defective products during mass production.

Although the shunt capacitors Cb can be dispensed with, in this case, the outside dimensions of the shunt transformer have to be made sufficiently large. An increase in configuration leads to an increase in the self-resonance frequency of the coil having the same inductance value. In other words, the commercialization of shunt transformers has been insufficient or obstructed until the present invention has been made, mainly due to incomplete disclosure of details of the techniques.

Further, in the example of the conventional current balancer, saturation of the core, which is caused by imbalanced currents in the current balancer, for example, when one of the discharge lamps is unlighted, is regarded as harmful, and hence the saturation is detected by additionally providing a winding in the shunt transformer, for detection of abnormality of the circuit. If abnormality of the circuit is detected, operation of the circuit is blocked.

When a large number of discharge lamps are to be simultaneously lighted by the conventional inverter circuit for a discharge lamp, the discharge lamps cannot be connected to each other simply in parallel with each other even if they have the same load characteristics. This is because the discharge lamp has a characteristic that when the current flowing therethrough is increased, the voltage thereof is decreased, that is, a so-called negative resistance characteristic, and hence even if a plurality of discharge lamp loads are connected in parallel, only one of them is lighted, while all the others are unlighted.

To cope with the above problem, in the multi-lamp lighting circuit, as shown in FIG. 16, a method of shunting the output of the step-up transformer on the secondary winding side using capacitive ballasts is generally employed. However, the circuit for shunting the output of the step-up transformer using the capacitive ballasts is a simplified circuit, but suffers from the following various problems, which will be described hereinafter with reference to FIG. 16.

In an inverter circuit for cold-cathode fluorescent lamps, shown in FIG. 16, assuming that the cold-cathode fluorescent lamps have a length, for example, of approximately 300 mm, the discharge voltage of each cold-cathode fluorescent lamp is generally approximately 600 V to 800V. In this circuit, when the discharge current is stabilized by using the capacitive ballasts, the reactance of the capacitive ballasts are inserted in series with respect to the discharge lamps, so that a voltage obtained by adding up the voltage of the cold-cathode fluorescent lamp and a voltage applied to the capacitive ballasts comes to 1200 V to 1700 V. The thus obtained voltage is the voltage of the secondary winding of the step-up transformer, and hence a high voltage of 1200 V to 1700 V is continuously applied to the secondary winding of the step-up transformer, which causes various problems.

One of the problems is electrostatic noise irradiated from a conductor having a voltage of 1200 V to 1700 V, which requires electrostatic shielding as a countermeasure against the radiation noise.

The above high voltage induces generation of ozone. The ozone enters metal portions via soldered portions of the secondary winding or pin holes of the same. This causes metal ions, such as copper ions, to be generated, which move to enter plastics of winding bobbins of the transformer, sometimes lowering the withstand voltage of the winding bobbin.

Further, the metal ions move along the secondary winding, so that the secondary winding can be sometimes burned due to inter-layer short circuits (layer short circuits) caused by the metal ions.

That is, the continuous application of a high voltage to the secondary winding brings about serious problems concerning the service life and management thereof since the above-described troubles occur as changes due to aging of the products after shipping thereof.

As a method free from the problems as described above, there is proposed a method of providing a leakage flux step-up transformer for each cold-cathode fluorescent lamp to stabilize lamp currents flowing through the cold-cathode fluorescent lamps by ballast effects brought by the leakage inductances of the step-up transformers, and resonating the leakage inductances with the capacitive component of the secondary circuit, to thereby obtain high conversion efficiency (Japanese Patent No. 2733817) as shown in FIG. 17. The discharge voltages of the cold-cathode fluorescent lamps directly become equal to the voltages of the secondary windings of the leakage flux step-up transformers, which enables the burden of the voltages of the secondary windings to be reduced. As a consequence, it is possible to drastically reduce the aging and occurrences of burnouts.

In this method, however, it is necessary to provide a leakage flux transformer and a control circuit for each of cold-cathode fluorescent lamps, which brings about the problems of increases in the circuit size and the manufacturing costs.

According to the above method of circuit configuration, it is possible to eliminating variation in lamp currents flowing through cold-cathode fluorescent lamps by detecting a lamp current flowing through each cold-cathode fluorescent lamp and stabilizing the lamp current by controlling an associated drive circuit of the transformer, and maintain the luminance of a liquid crystal display backlight at an averaged and constant level until just before the end of service life thereof. Therefore, the circuit system is in widespread use as an excellent system, in spite of the problem of costs.

Therefore, as acceptable compromise for improvement the above method in respect of costs thereof, an attempt has also been made to reduce costs of transformers, by assembling a plurality of leakage flux transformers, for example, to provide one primary winding with two secondary windings, or put together two leakage flux transformers using one core, as shown in FIGS. 18 and 19.

In this method, however, it is not possible to control individual electric currents flowing through a plurality of cold-cathode fluorescent lamps connected to a transformer, so that only one current control can be carried out on the primary winding of the transformer. Further, when there occurs an imbalance between lamp currents flowing through the cold-cathode fluorescent lamps connected to the secondary windings formed as an assembly, it is almost impossible to make the currents balanced with each other.

Although the above description has been given of the winding transformer, the same problem occurs with an inverter circuit using a piezoelectric transformer.

The piezoelectric transformer is sometimes fractured when a step-up ratio thereof is increased to obtain a high voltage. Therefore, it is not practical to light a plurality of cold-cathode fluorescent lamps by increasing the step-up ratio, and shunting electric current into a plurality of cold-cathode fluorescent lamps using the capacitive ballasts.

Accordingly, in general, one piezoelectric transformer can be connected to only one cold-cathode fluorescent lamp, and hence the use of a piezoelectric inverter circuit has been limited.

On the other hand, an attempt has been made to apply the use of current balancers, which have been realized in hot-cathode lamps, to cold-cathode fluorescent lamps to thereby simultaneously light approximately two to four lamps cold-cathode fluorescent lamps, while suppressing variation in currents.

However, the shunt capacitors Cb increases voltage applied to the secondary windings of transformers, causing acceleration of aging thereof, so that it is desirable to eliminate the shunt capacitors if possible. When a large number of cold-cathode fluorescent lamps are arranged in parallel for multi-lamp lighting, in most cases, the effect thereof is very unstable, and it sometimes becomes impossible to obtain the shunting and balancing effects all of a sudden, with a different construction of a backlight or a different type of cold-cathode fluorescent lamps. To overcome this problem, a shunt capacitor Cb also serving as a ballast capacitor is provided in series with each fluorescent lamp so as to enable all the cold-cathode fluorescent lamps to be lighted even when the balancing effect is lost.

On the other hand, in the case of a shunt transformer for hot-cathode lamps, the shunting and current-balancing effects can be obtained without provision of shunt capacitors. This is because the shunt transformer can be relatively large in size since a large space for containing the shunt transformer can be provided, and it is desired that the core is prevented from being saturated by the imbalance of currents flowing through the shunt transformer, when one or some of hot-cold-cathode fluorescent lamps are unlighted.

Further, in the hot-cathode lamp, in general, there is a large voltage difference between a constant discharge voltage and a discharge starting voltage, and particular operation is required at the start of discharge. This necessitates additional operation of causing lighting of hot-cathode lamps by some kind of means.

The same applies to the lighting circuit for lighting cold-cathode fluorescent lamps, and it is necessary to perform operation of causing lighting of cold-cathode fluorescent lamps by some kind of means.

In the case of a circuit shown in FIG. 20, the effect of causing lighting of cold-cathode fluorescent lamps C is entrusted to the operation of the ballast capacitors Cb connected in series to the respective cold-cathode fluorescent lamps C, whereby the major shunting effect is obtained. In this method, however, similarly to the conventional inverter circuit, a high voltage is continuously generated in the secondary winding. Therefore, the problem of continuous application of a high voltage to the secondary winding is not alleviated.

As described above, it is desired to eliminate the shunt capacitors Cb, if possible, since they increase the voltage applied to the secondary winding, and accelerates aging. However, to guarantee a stable shunting effect while eliminating the shunt capacitor Cb, it is essential to control voltage-current characteristics observed as the result of mutual operation between the cold-cathode fluorescent lamp and a conductor (also serving as a metal reflector, in general) close to the cold-cathode fluorescent lamp.

Particularly, it is necessary to guarantee a negative resistance characteristic obtained from the voltage-current characteristics as a specification value. However, those skilled in the art have not recognized the necessity of controlling such a negative resistance characteristic from the early days of the liquid crystal display backlight up to the present time, so that an adequate reactance value that guarantees a stable shunting effect is obscure. Therefore, the shunt capacitors Cb have been indispensable, and when the capacitors Cb are eliminated, it is impossible to avoid increasing the shunt transformer so as to cause the shunt transformer to have a sufficient and excessive reactance value.

Further, reduction of the size of a shunt transformer based on the excessively set reactance value makes the self-resonance frequency of the shunt transformer too low, which impairs the effect of reactance related to shunting, so that the shunting effect is lost. As a consequence, the shunt capacitors Cb become indispensable again. Thus, the process goes round in circles to get nowhere.

Further, as a means for protection in case of failure of lighting due to abnormally occurring in one or some of discharge lamps, there has been conventionally provided a winding for detecting distorted current caused by magnetic saturation of the current balancer, for detection of abnormality. However, the protecting means has no operation or effect of protecting the shunt transformer itself.

Further, the conventional method of detecting abnormality is based on detection of deformation of the waveform of magnetic flux generated in the current balancer, and a means of the detection is not simple.

Further, to increase the size of the shunt transformer so as to prevent the saturation of the shunt transformer inversely leads to an increase in core loss caused by the saturation of the shunt transformer. This has caused generation of a considerable amount of heat.

Furthermore, the cold-cathode fluorescent lamp, which has a high constant discharge voltage, is largely influenced by the parasitic capacitance generated in nearby associated circuit components and wiring connected thereto, so that if the parasitic capacitances occurring in wiring between an inverter circuit and cold-cathode fluorescent lamps are different, imbalance in currents flowing through the cold-cathode fluorescent lamps is caused.

SUMMARY OF THE INVENTION

The present invention has been made in view of the above problems, and an object thereof is to provide An inverter circuit for discharge lamps for multi-lamp lighting, which is capable of eliminating of an excessively high reactance and providing shunting characteristics high in performance while reducing the size thereof, by paying attention to the negative resistance characteristic of fluorescent lamps, controlling the value thereof, and causing a shunt transformer to have a reactance exceeding the negative resistance characteristic, without making the reactance related to shunting operation of a current balancer fairly large with respect to the equivalent impedance of the fluorescent lamps.

The major construction of the invention consists of an inverter circuit for discharge lamps for multi-lamp lighting, two coils connected to a secondary winding of a step-up transformer of the inverter circuit are arranged and magnetically coupled to each other to form a shunt transformer for shunting current such that magnetic fluxes generated thereby are opposed to each other to cancel out, wherein discharge lamps are connected to the coils, respectively, with currents flowing therethrough being balanced with each other, and wherein lighting of each of the discharge lamps is caused by the fact that a reactance of an inductance related to balancing operation of the shunt transformer, the reactance being in an operating frequency of the inverter circuit, exceeds a negative resistance the said discharge lamps connected to the shunt transformer is not lighted, a core of the shunt transformer is saturated by a current flowing through a lighted one of the discharge lamps, whereby a voltage having a high peak value is generated at a terminal of the unlighted discharge lamp of the shunt transformer, thereby applying a high voltage to the unlighted discharge lamp. The shunt transformers are connected to each other in a form of a tournament tree, as appropriate. Lamp currents of a plurality of discharge lamps are simultaneously balanced with each other with respect to one inverter output. Or the inverter circuit includes a shunt transformer configured to have three or more coils arranged such that magnetic fluxes generated by the respective coils are opposed to each other to cancel out, whereby respective lamp currents of discharge lamps connected to the coils are simultaneously balanced with each other. Or the inverter circuit is configured such that the step-up transformer is replaced by a piezoelectric transformer. Further, by properly arranging a diac in parallel with each winding of the shunt transformer, whereby the shunt transformer is protected when a discharge lamp becomes abnormal or is unlighted, and at the same time, detection for abnormality is performed.

The present invention solves problems peculiar to the inverter circuit for cold-cathode fluorescent lamps by applying shunt transformers conventionally used for hot-cathode lamps to cold-cathode fluorescent lamps, and provides lots of advantageous effects, by combining shunt transformers with cold-cathode fluorescent lamps.

Further, the shunt transformer itself is entrusted with the operation of causing lighting of unlighted ones of cold-cathode fluorescent lamps when part(s) of the cold-cathode fluorescent lamps is/are unlighted due to reduction of the cross-sectional area of the core of a shunt transformer, by configuring such that the shunt transformer has a large reactance, whereby all the cold-cathode fluorescent lamps are uniformly lighted, and at the same time the currents are caused to be balanced with each other.

Still further, when the core of a shunt transformer is saturated, a pulsed and distorted high voltage waveform including a harmonic component is generated at a coil terminal on the unlighted side. By making use of this phenomenon, even when the slope of the negative resistance of a discharge lamp is large, all the cold-cathode fluorescent lamps are caused to be lighted, and at the same time the currents are caused to be balanced with each other.

Further, by actively allowing the saturation of the core, which has been conventionally regarded as harmful, it is possible to downsize the shape of the shunt transformer to its limit.

Further, by actively allowing the saturation of the core, and at the same time reducing the cross-sectional area of the core, the amount of heat generated by the saturation is reduced.

As described above, by providing transformers for shunting current in a secondary circuit of the step-up transformer of the inverter circuit, it is possible to shunt the output of the step-up transformer, simultaneously light two or more discharge lamps, and at the same time cause the currents to be balanced with each other, whereby it is made possible to drastically reduce the step-up transformer or a control circuit, or both of them, thereby realizing reduction of costs.

Further, as described above, so long as shunt transformers that have a large reactance or actively allowing saturation of cores thereof are applied to cold-cathode fluorescent lamps, there is no need to take particular countermeasures against the problem of failure of lighting of cold-cathode fluorescent lamps, thereby making the lighting circuit very simple and easy to design.

Further, the invention provides an abnormality-detecting means in the form of a simple circuit in which when abnormality has occurred in any of discharge lamps, a voltage generated in an associated winding of the shunt transformer is detected by a diode, thereby detecting the abnormality.

Furthermore, as to an inverter circuit for cold-cathode fluorescent lamps, largely influenced by a parasitic capacitance, it is possible to reduce the influence of the parasitic capacitance by arranging shunt transformers on the low-voltage side.

Even when shunt transformers are arranged on the high-voltage side, the shunt transformers can be arranged in the form of a tournament tree, more specifically, by winding two windings of coils of each shunt transformer such that magnetic fluxes generated by said respective windings are opposed to each other, and connecting one ends of the windings to each other, with each of the other ends of said two windings other than the one ends connected to each other being connected to one ends of two windings of another shunt transformer, the one ends being connected to each other, whereby shunt transformers are sequentially connected to each other to form a multi-tier or pyramid-like structure. Therefore, it is easy to make the length of high-voltage wires equal to each other, and possible to dispose the cold-cathode fluorescent lamps in the vicinity of the shunt transformer, so that the influence of the parasitic capacitance can be reduced.

Although a smaller amount of current flows through the windings of shunt transformers in a lower tier of the structure in the form of a tournament tree, a larger amount of current flows in a concentrated manner as the shunt transformer belongs to an upper layer of the structure. Therefore, when the number of turns of each winding and the diameter of the wire are the same, a shunt transformer in an upper layer generates a larger amount of heat.

When the shunt transformer is arranged on the low-voltage side, the abnormality-detecting circuit can be made simpler.

Furthermore, as for the inverter circuit using the leakage flux transformers, it is possible to provide an inverter circuit capable of multi-lamp lighting without spoiling safety and high reliability thereof.

Still further, as for a piezoelectric transformer with only one output, it is also possible to provide an inverter circuit capable of multi-lamp lighting by using the same.

Further, by forming the windings of the two coils of a shunt transformer by an oblique winding method shown in FIG. 21, which is disclosed in U.S. patent No. 2002/0140538, Japanese Patent Nos. 2727461, and 2727462, it is possible to increase the self-resonance frequency of each coil, and obtain a high shunting/current-balancing effect of the shunt transformer in spite of its small size.

BEST MODE FOR CARRYING OUT THE INVENTION

The invention will now be described in detail with reference to FIGS. 1 to 15 showing embodiments thereof.

Figure 1:
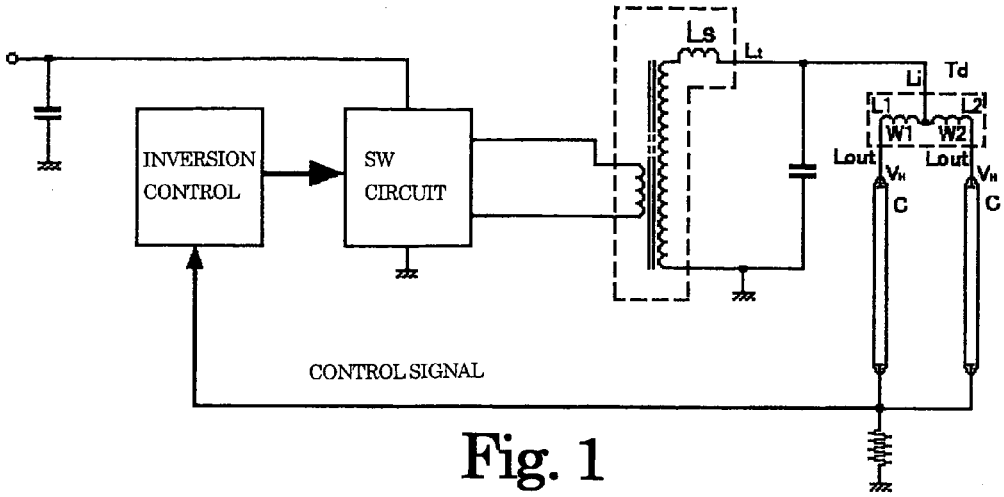
FIG. 1 is a diagram showing a circuit configuration showing an example of a comprehensive embodiment, which is useful in explaining the principle of the present invention.

FIG. 1 is a diagram of a comprehensive embodiment showing the principle of the present invention, in which there are arranged coils $L_1$ and $L_2$ having windings $W_1$ and $W_2$ wound therearound, respectively, on the secondary side of a leakage flux transformer Ls, which is a step-up transformer of an inverter circuit for discharge lamps, and opposed one ends $L_1$ of the coils $L_1$ and $L_2$ are connected to each other, and connected to a secondary winding $L_t$ of the leakage flux transformer Ls. The other ends $L_{out}$ of the coils $L_1$ and $L_2$ are connected to high voltage terminals $V_H$ of cold-cathode fluorescent lamps C, respectively.

Magnetic fluxes generated by the coils $L_1$ and $L_2$ are connected such that they are opposed to each other, and it is necessary to increase a coupling coefficient to some extent, i.e. to ensure a certain high mutual inductance. When electric currents flowing through the windings $W_1$ and $W_2$ are equal to each other, respective voltages generated across the coils $L_1$ and $L_2$ are lower as the coupling coefficient is higher. Ideally, if the coupling coefficient is 1, and the cold-cathode fluorescent lamps C have the same characteristics, the generated voltages are zero.

More specifically, the two cold-cathode fluorescent lamps C are connected to the secondary side of the step-up transformer, i.e. leakage flux transformer Ls of the inverter circuit for discharge lamps, via a shunt transformer Td for shunting current, in which the two coils $L_1$ and $L_2$ thereof having the windings $W_1$ and $W_2$ are connected to the secondary winding Lt of the transformer Ls, and the two coils $L_1$ and $L_2$ are magnetically coupled to each other such that the magnetic fluxes generated thereby are opposed to cancel out.

As described above, when electric current is shunted by connecting the shunt transformer Td to the transformer Ls, it is possible to light two cold-cathode fluorescent lamps C with respect to one secondary winding of the leakage flux transformer Ls. The shunt transformer Td is disposed such that the magnetic fluxes generated by the windings $W_1$ and $W_2$ are opposed to each other, and operates such that electric currents flowing through the cold-cathode fluorescent lamps C are balanced, to thereby supply equal currents to the two cold-cathode fluorescent lamps C connected thereto.

The shunt transformer configured as above is designed such that it has a core small in cross-sectional area, concretely, as a small-sized transformer, whereby when one of the cold-cathode fluorescent lamps is not lighted to make the electric currents imbalanced, the core is saturated with magnetic fluxes generated by the imbalanced electric currents, which causes a distorted voltage having a high peak value to be generated at a terminal of the shunt transformer, on the unlighted side.

Next, a description will be given of individual embodiments to which the above principle is applied.

In general, in the case of an inverter circuit for cold-cathode fluorescent lamps having a frequency of 60 $KH_z$, the impedance of the cold-cathode fluorescent lamp C has a value of approximately 100 kΩ to 150 kΩ. If the shunt transformer Td has the coils $L_1$ and $L_2$ of which the respective inductances are equal to each other and in a range of 100 mH to 200 mH, and of which the coupling coefficient is equal to or higher than 0.9, the value M of the mutual inductance is determined by the following equation:

$$M=k\cdot Lo$$

For example, if the self inductance of each coil is 100 mH, and the coupling coefficient is 0.9, the mutual inductance is calculated as follows:

$$0.9\times 100\text{ mH}=90\text{ mH}$$

Now, when the reactance value of the mutual inductance at 60 $KH_z$ is calculated, the following value is obtained:

$$X_L=2\pi fL=2\times\pi\times 60\times 10^3\times 90\times 10^{-3}=34\ k\Omega$$

Under the above conditions, it was possible to light two cold-cathode fluorescent lamps C having an impedance of approximately 100 kΩ to 150 kΩ, to thereby obtain a current-balancing function for practical use.

This means that if the reactance is approximately 20% or more of the impedance of the cold-cathode fluorescent lamp C, it is possible to cause the cold-cathode fluorescent lamp C to have a sufficient current-balancing function. The cold-cathode fluorescent lamp C is not required to have a reactance well higher than the impedance (approximately 100 kΩ) of a cold-cathode fluorescent lamp of the general type.

Now, a description will be given of the difference between conventional knowledge and the viewpoint of the present invention.

For the mutual inductance of the shunt transformer to serve as a reactance in the inverter circuit to cause lighting of the cold-cathode fluorescent lamps C, it is necessary to meet the requirements described below.

In general, cold-cathode fluorescent lamps are often conventionally used as liquid crystal display backlights. In this case, when a reflector arranged close to a cold-cathode fluorescent lamp is electrically conductive, a conductor proximity effect is caused in the discharge characteristic of the cold-cathode fluorescent lamp, whereby voltage-current characteristic curves as shown in FIG. 11 are obtained.

Figure 11:
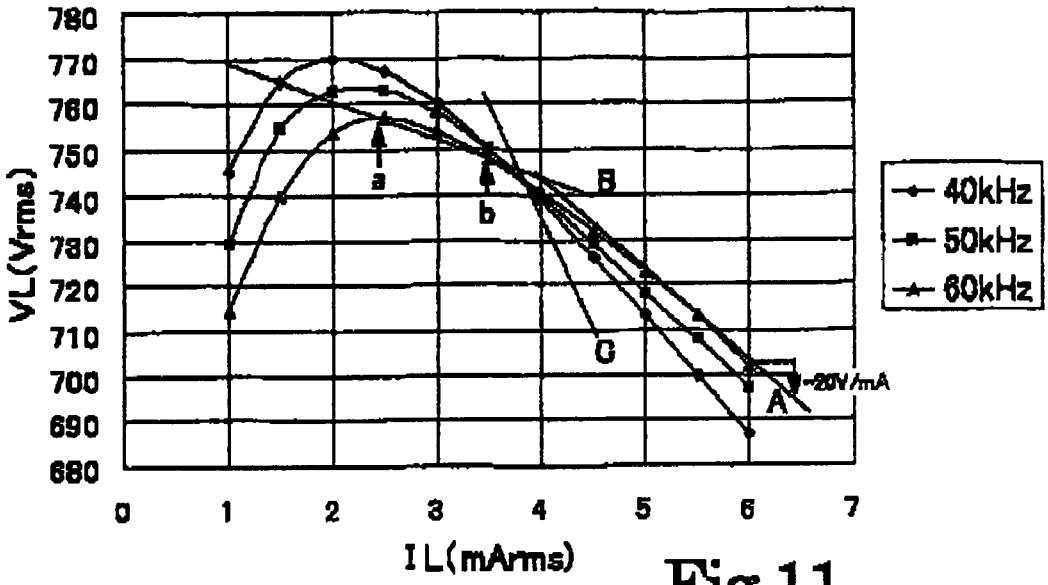
FIG. 11 is a graph showing voltage-current characteristic curves of a cold-cathode fluorescent lamp in a liquid crystal display backlight panel.

A negative resistance value of the cold-cathode fluorescent lamp is represented by the slope of a voltage-current characteristic curve, for example, as indicated by A in FIG. 11 (a case of 60 $kH_Z$). In the case of the slope A in FIG. 11, the negative resistance value is −20 kΩ (−20 V/mA).

Now, when the reactance of the mutual inductance of the shunt transformer, in the operating frequency of the inverter, is shown with its slope being inverted for comparison purposes, B or C is obtained. In this case, the reactance value of the mutual inductance is twice as large as that of a reactance on one side, since the two shunt coils have respective windings wound therearound such that magnetic fluxes generated by the two windings are opposed to each other.

In the case of the slope B wherein the reactance is smaller than the negative resistance characteristic, there are formed two points a and b of intersection of the slope B with voltage-current characteristic curves. More specifically, when two cold-cathode fluorescent lamps are to be lighted, if one of the cold-cathode fluorescent lamps is lighted to cause current flowing through to start to be increased, in a stage where the current is being increased, the one cold-cathode fluorescent lamps enter a negative resistance area illustrated on a right side of FIG. 11. The other cold-cathode fluorescent lamp connected to the other coil of the shunt transformer is reduced in current to enter a positive resistance area illustrated on the left side of FIG. 11. Thus, one cold-cathode fluorescent lamp is lighted, whereas the other cold-cathode fluorescent lamp is not lighted.

To overcome the above phenomenon to cause the shunt transformer to have a capability of lighting both of the cold-cathode fluorescent lamps, it is necessary to configure the shunt transformer such that it has a reactance, for example, by a slope C which is at least well larger than the slope representing the negative resistance of the cold-cathode fluorescent lamp.

More specifically, in the example illustrated in FIG. 11, the mutual inductance of one of the coils of the shunt transformer is required to have a reactance larger than 10 kΩ which is half the value of 20 kΩ.

Figure 12:
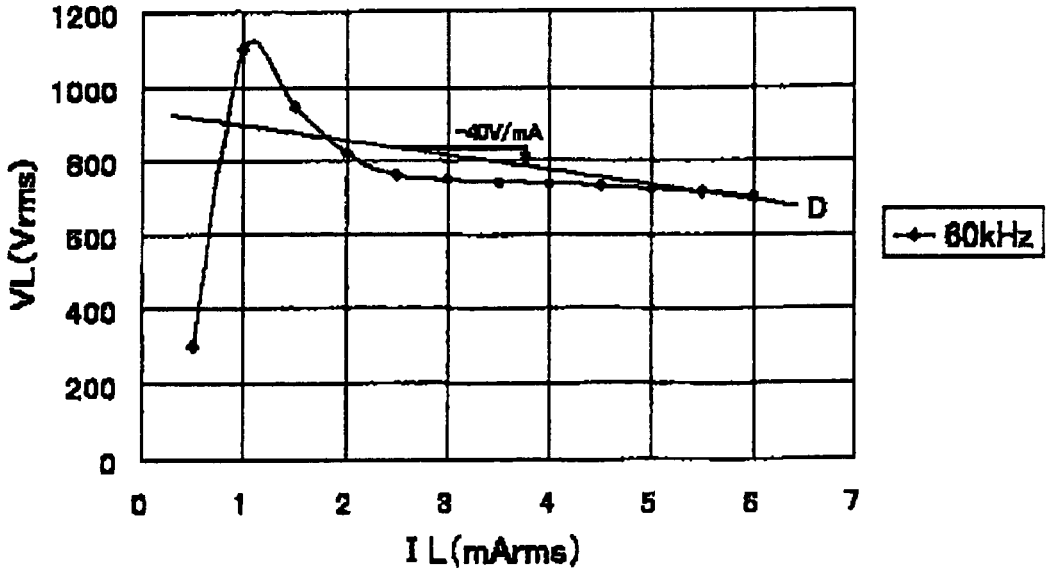
FIG. 12 is a graph showing a voltage-current characteristic curve of a cold-cathode fluorescent lamp in a liquid crystal display backlight panel.

On the other hand, some liquid crystal display backlights are configured such that no significant conductor proximity effect is caused due to its structure, thereby exhibiting a voltage-current characteristic curve shown in FIG. 12. In this case, it is difficult to light the cold-cathode fluorescent lamps with only the above reactance effect of the shunt transformer. The reason is as follows: A slope D in FIG. 12 represents an example of a reactance of 40 kΩ, and even this value, the slope has two points of intersection with the voltage-current characteristic curve. Although in theory, the above problem can be solved by further increasing the reactance value, it is difficult to secure a larger reactance value by the state-of-the art manufacturing technique at the time of application of the present invention. To light the two cold-cathode fluorescent lamps only by a single shunt transformer in the above state, lamp electric current has to be increased to a value far larger than 7 mA, which causes burnout of the cold-cathode fluorescent lamps.

Figure 10:
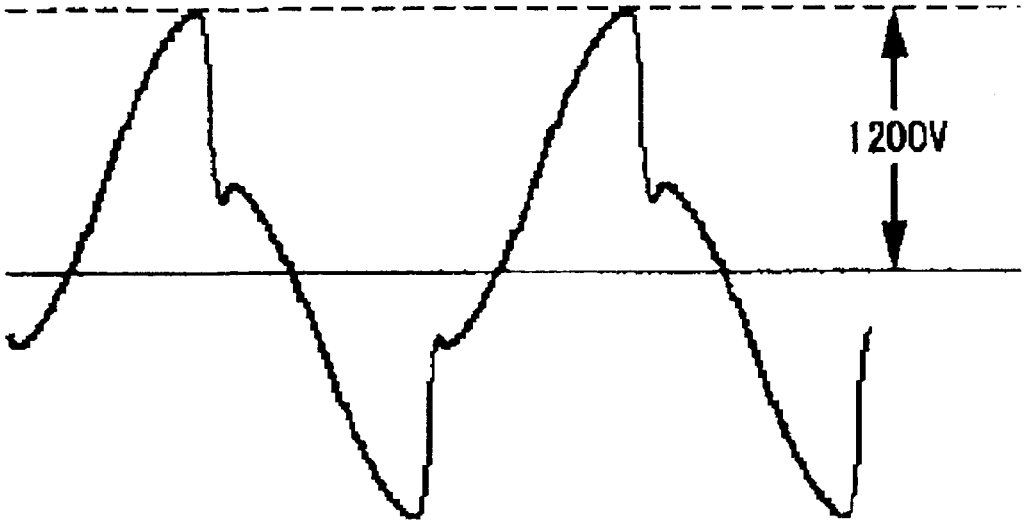
FIG. 10 is a diagram showing an example of a waveform of a voltage with a high peak value, which is generated at a terminal of a shunt transformer on an unlighted side, when a core is saturated by a current flowing through a lighted cold-cathode fluorescent lamp.

Although in general, lamp electric current flowing through the cold-cathode fluorescent lamps frequently has a value between 3 mA to 7 mA, if the number of turns of each coil is increased for the above reason, and the core of the shunt transformer is designed to have a small cross-sectional area assuming that electric current flowing through the cold-cathode fluorescent lamps is balanced, the core is easily saturated by imbalanced electric current when one of the cold-cathode fluorescent lamps is not lighted. As a result, a distorted voltage waveform having a high peak value, as shown in FIG. 10, is generated at a coil terminal on the unlighted side. The distorted waveform has a higher peak value, as the rate of saturation of the core is increased.

In the FIG. 12 example, since the lighting of the cold-cathode fluorescent lamps is caused by the voltage, there is no need to particularly increase the reactance of the shunt transformer.

Figure 2:
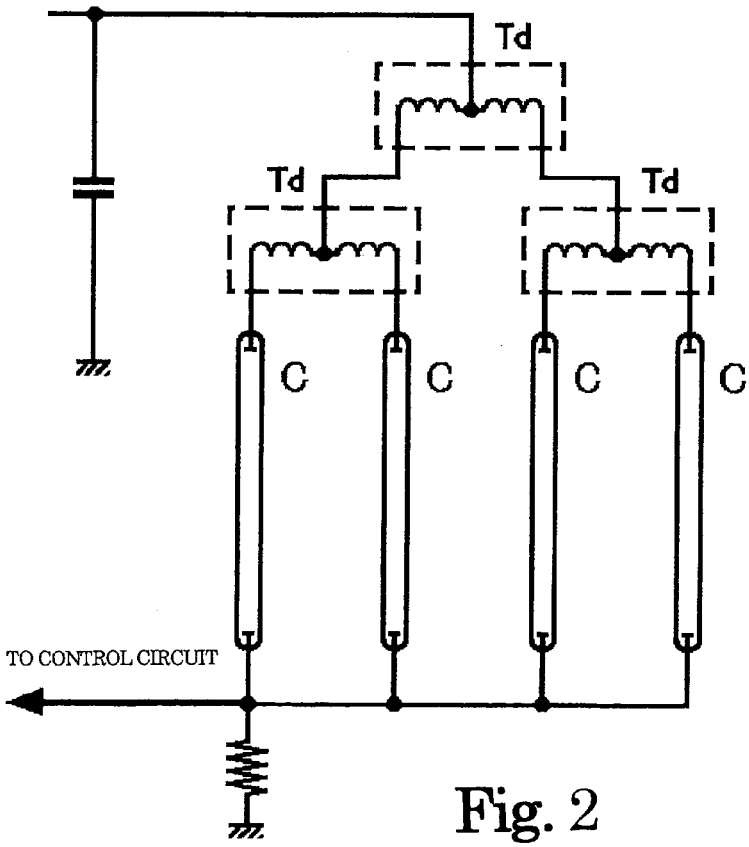
FIG. 2 is a diagram showing a circuit configuration of essential parts of another embodiment of the present invention.

Although the above description is given of an example of lighting two cold-cathode fluorescent lamps, when four or eight or more cold-cathode fluorescent lamps are to be lighted, as shown in FIG. 2, if the shunt transformers Td are connected to each other in the form of a tournament tree, more specifically, if the two windings of the coils of each shunt transformer are wound around such that magnetic fluxes generated by the respective windings are opposed to each other, and one end of the windings are connected to each other, with each of the other ends of the two windings other than the one ends connected to each other being connected to one end of two windings of another shunt transformer, connected to each other, whereby the shunt transformers are sequentially connected to each other to form a multi-tier and/or pyramid-like structure, it is possible to light a large number of cold-cathode fluorescent lamps simultaneously, and at the same time balance electric currents flowing therethrough.

Especially when the shunt transformers are connected to each other to form a multi-tier structure, the reactance value of an upper shunt coil is sequentially progressively made smaller than that of lower shunt coils, whereby the number of turns of the shunt coils is progressively reduced.

In the above case, although the amount of current flowing through the windings of each shunt transformer at a lower tier is small, but larger amount of current flows by concentration in a shunt transformer at an upper stage. Therefore, it is reasonable to reduce the number of turns of each winding, and at the same time increase the diameter of the wire as required to thereby progressively reduce magnetic fluxes generated by the windings.

Figure 3:
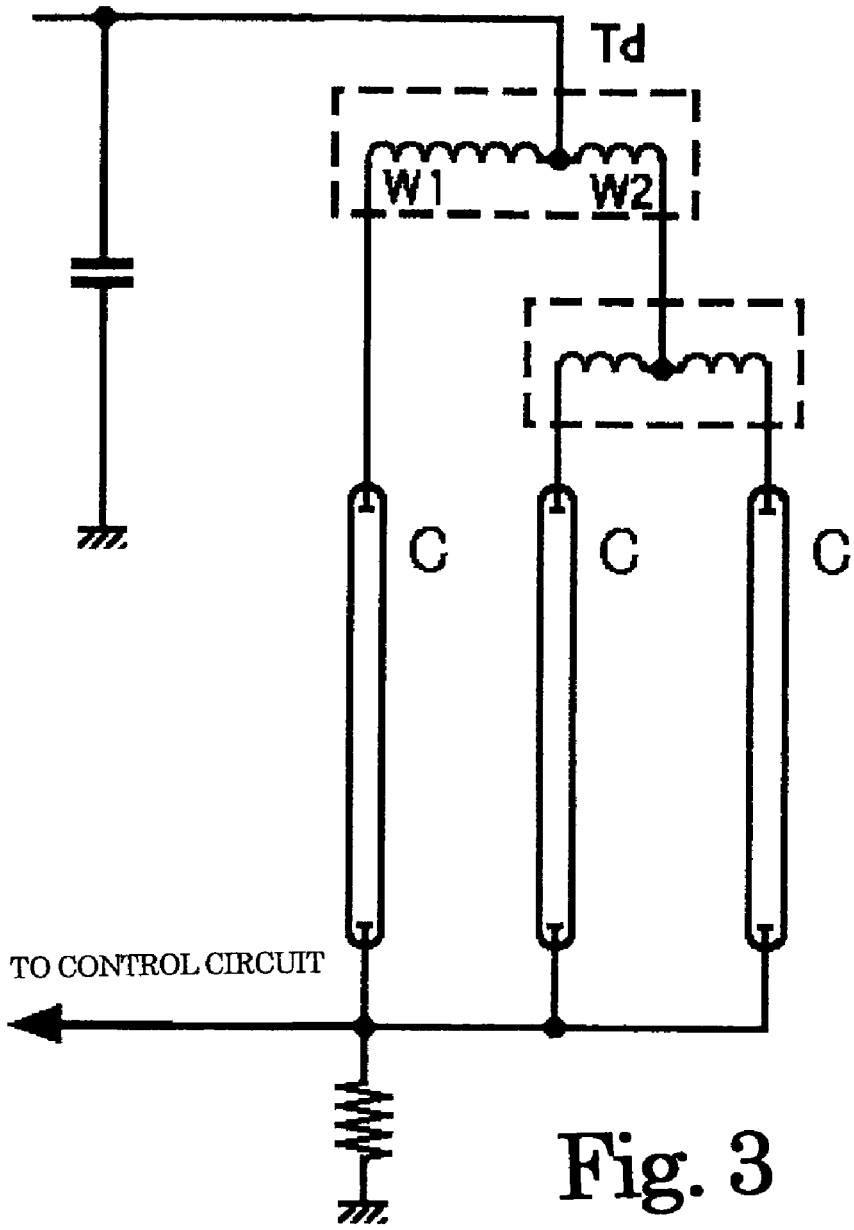
FIG. 3 is a diagram showing a circuit configuration of essential parts of still another embodiment of the present invention.

Next, FIG. 3 shows an example of lighting three cold-cathode fluorescent lamps. In this case, the numbers of turns of two windings of shunt transformer Td are at a ratio of 2:1. Through a winding $W_2$ having a smaller number of turns, those flows a current twice as large as current flowing through a winding $W_1$ having a larger number of turns, whereby magnetic fluxes generated by the shunt transformer are balanced. With the above configuration, it is possible to obtain the current-balancing function also in a circuit for lighting three lamps.

The same method makes it possible to light five, six or more lamps.

Figure 4:
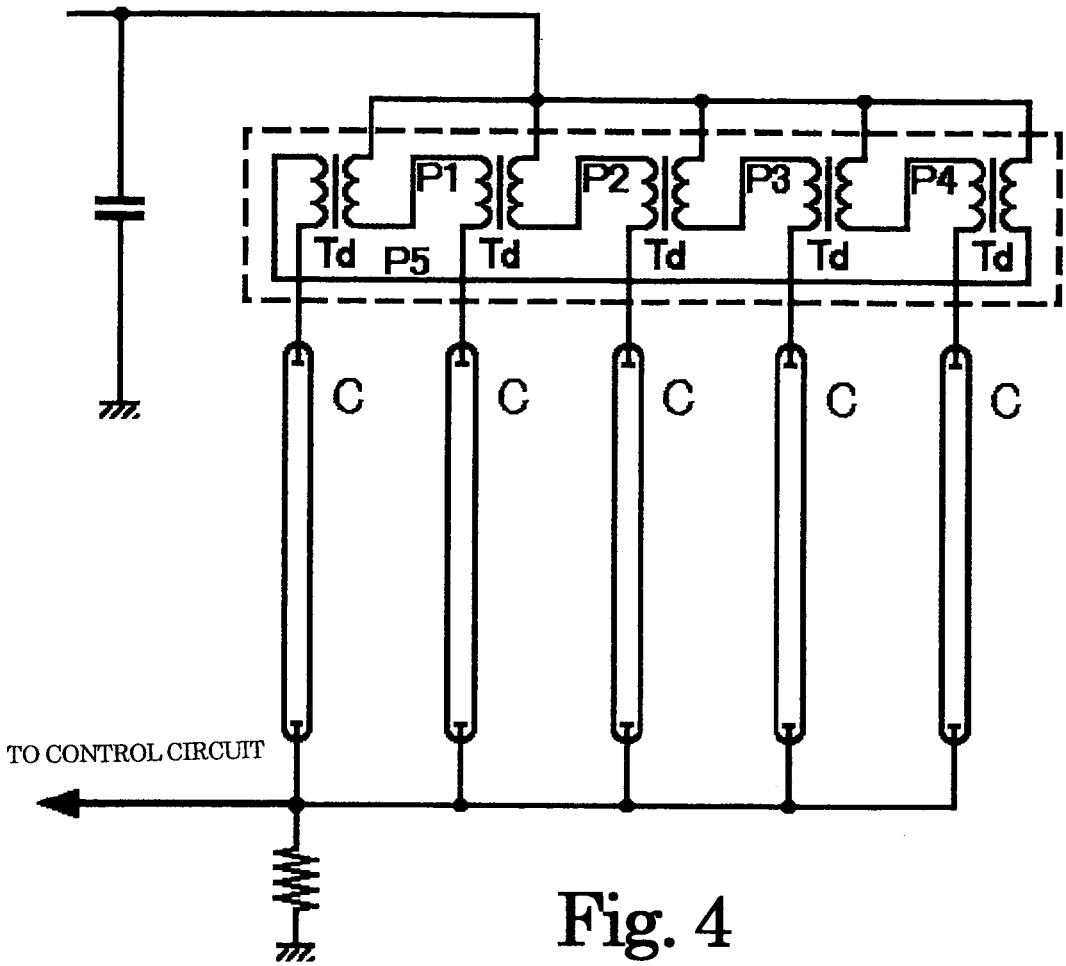
FIG. 4 is a diagram showing a circuit configuration of essential parts of an embodiment as a disimprovement invention of the present invention.

Next, FIG. 4 shows a shunt circuit formed by connecting one coil of a shunt transformer to one coil of a shunt transformer in a next stage, connecting the other coil of the shunt transformer in the next stage, to one coil of a shunt coil in a further next stage, and providing a required number of similar connections such that the connecting relationship is formed in a turnaround fashion between all the coils of the shunt transformers. In this case, unless the transformation ratios of shunt coils are accurately controlled, a serious problem is caused. This is because the transformers are connected in a circulating manner, and hence even when there exists a small difference in transformation ratio, electric current flows between the shunt transformers to absorb a voltage generated due to the small difference in the transformation ratio. This current is useless, and offers an impediment to the downsizing of the shunt transformer.

Therefore, when the shunt transformers are arranged as shown in FIG. 4, it is necessary to considerably increase the leakage inductance of each shunt transformer so as to suppress current flowing between the shunt transformers. In this case, it is essential that the leakage inductance of each shunt transformer is large.

Further, the increase in the leakage inductance offers an impediment to the downsizing of the shunt transformer in another sense, so that although the FIG. 4 arrangement is less advantageous than the FIG. 2 arrangement, it is an example which can be put to practical use except for precision uses.

Figure 5:
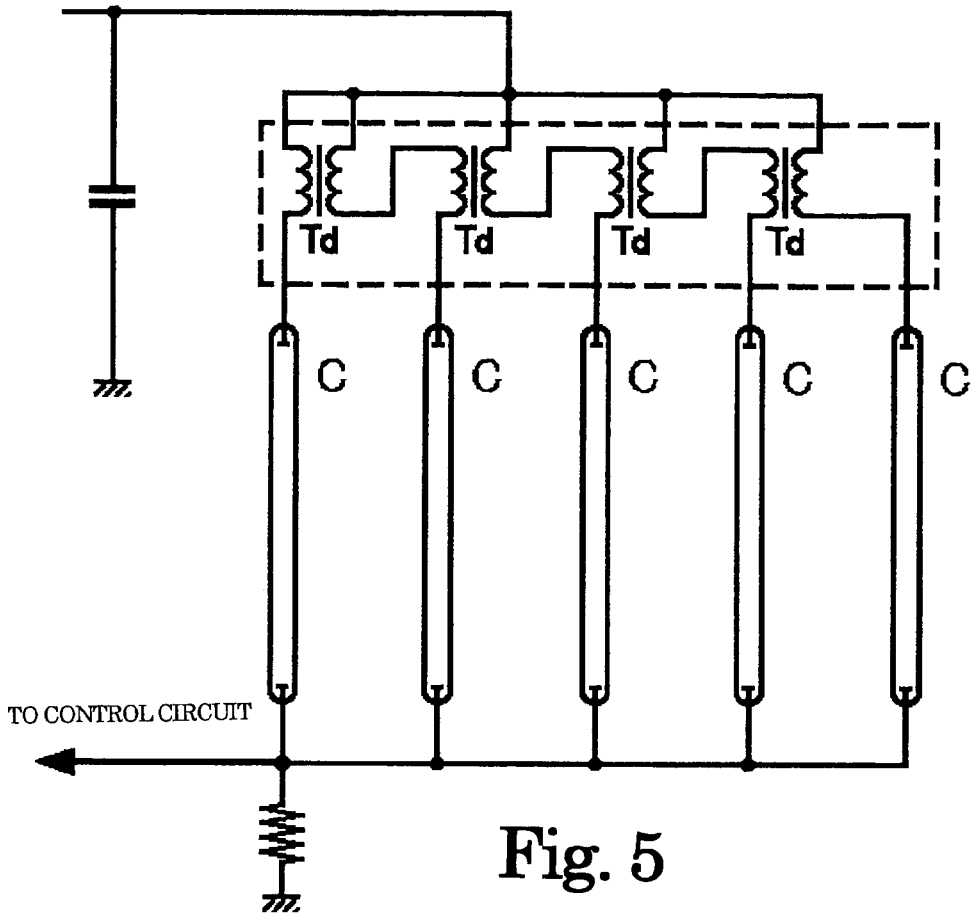
FIG. 5 is a diagram showing a circuit configuration of essential parts of still another embodiment as a disimprovement invention of the present invention.

Further, if a wiring P5 is disconnected to form a configuration as shown in FIG. 5, there occurs no electric current flowing muturally through the shunt transformers. A glance at FIG. 5 indicates that although this example is imbalanced in reactance relative to each discharge lamp, it can be put to practical use.

Figure 6:
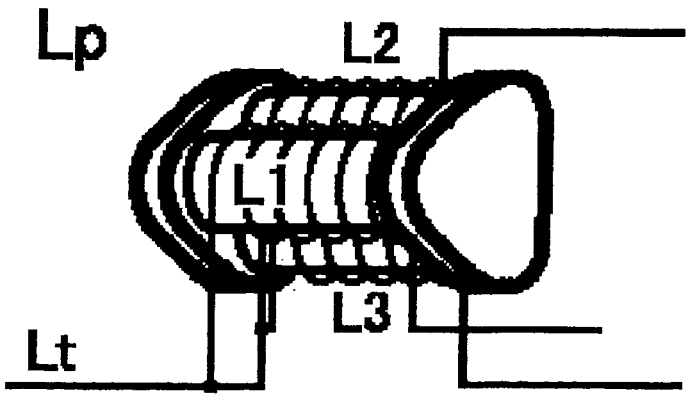
FIG. 6 is a perspective view showing the construction of a coil as an essential part of still another embodiment of the present invention.
Figure 7:
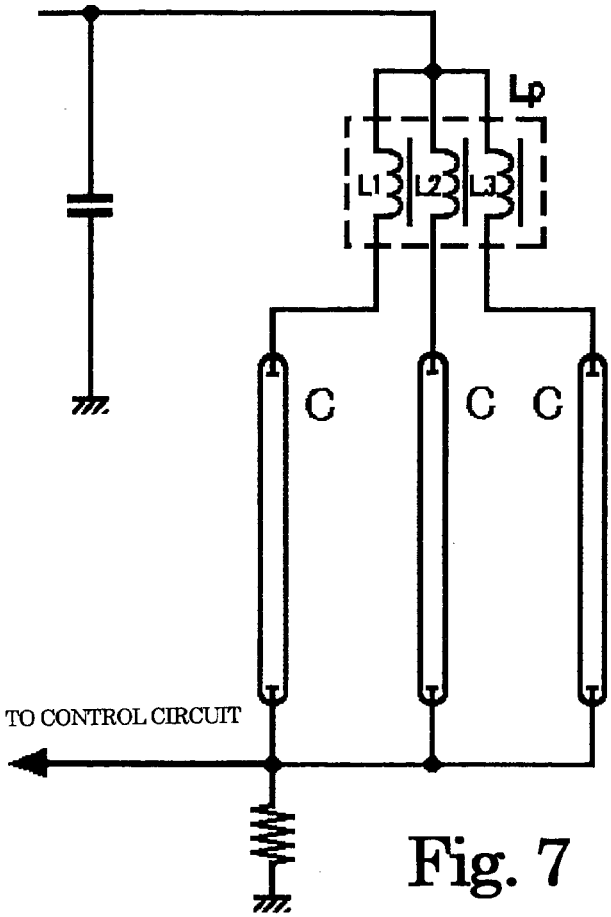
FIG. 7 is a diagram showing a circuit configuration of essential parts of an embodiment incorporating a coil appearing in FIG. 6.

FIG. 6 shows an example of the arrangement of three balanced coils $L_p$. A circuit as shown in FIG. 7 is formed by the coils $L_p$, thereby making it possible to light three cold-cathode fluorescent lamps C, and at the same time balance electric currents flowing through the lamps. Similarly, if four or more coils are balanced, and the circuit as shown in FIG. 7 is formed by the coils, it is possible to light four or more cold-cathode fluorescent lamps C, and at the same time balance electric currents flowing through the lamps.

Now, the circuit formed by the above three coils is described with reference to FIG. 6. The coils $L_1$, $L_2$, and $L_3$ are wound around the core of a magnetic material, such as ferrite. The three coils have the same inductance, and are wound in the same direction. One ends $L_t$ of the coils are bundled to be electrically connected to each other. The bundle of one ends is connected to a high-voltage side secondary winding of a leakage flux step-up transformer in the FIG. 7 circuit, and the other ends of the coils are connected to respective associated cold-cathode fluorescent lamps C.

With this configuration, magnetic fluxes generated in the coils $L_1$, $L_2$, and $L_3$, by lamp currents flowing through the cold-cathode fluorescent lamps C are in the same direction. Further, by connecting the coils $L_1$, $L_2$, and $L_3$, to each other by the magnetic material, such as ferrite, the magnetic fluxes generated in the three coils $L_1$, $L_2$, and $L_3$, are opposed to each other for being balanced. Ideally, the ferrite material has a shape which can be most efficiently contained in a spherical shape or a rectangular parallelepiped, so as to increase the coupling coefficient between the coils.

If a core material has a silhouette extending along the axis of a winding, or it has a flat structure wide in the direction of the periphery of the winding, the coupling coefficient is small. When the coupling coefficient between the windings is small, to obtain a required mutual inductance, it is necessary to increase the number of turns of each winding, which results in the degraded volumetric efficiency. It should be noted that even when the coupling coefficient between the windings is small but the leakage inductance is large, the leakage inductance can be applied to other uses.

By the same method, it is possible to balance magnetic fluxes generated by four or more coils to balance lamp currents flowing through four or more cold-cathode fluorescent lamps.

Figure 8:
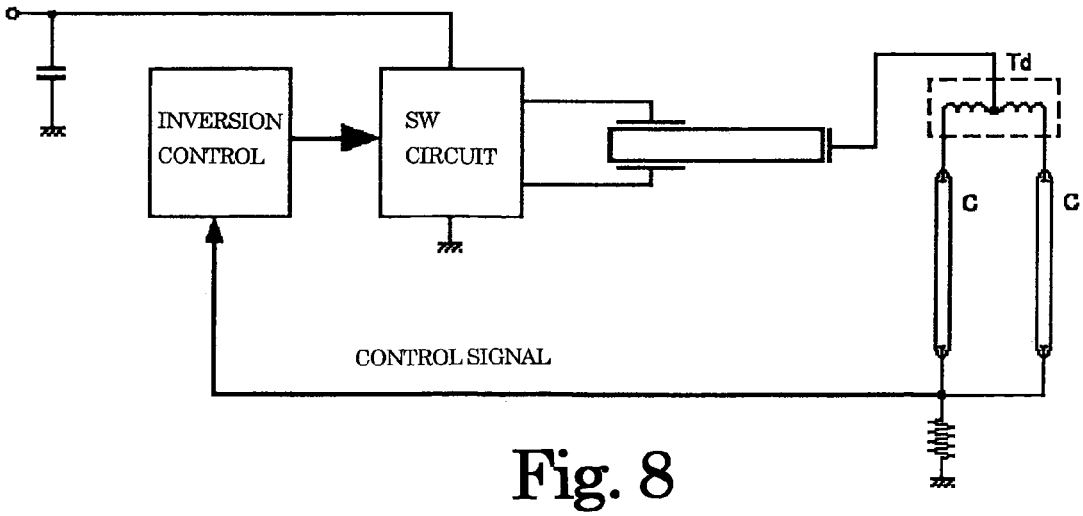
FIG. 8 is a diagram showing a circuit configuration of an example of an inverter circuit for lighting two lamps, constructed by using a piezoelectric transformer based on the principle shown in FIG. 1.

FIG. 8 shows an embodiment in which an inverter circuit for lighting two lamps is formed by using a piezoelectric transformer based on the FIG. 1 principle. Similarly, if the connecting methods shown in FIG. 2 to FIG. 7 are applied to an inverter circuit by using piezoelectric transformer(s), it is possible to form an inverter circuit for lighting three or more cold-cathode fluorescent lamps, and at the same time balance lamp electric current flowing through cold-cathode fluorescent lamps.

Figure 9:
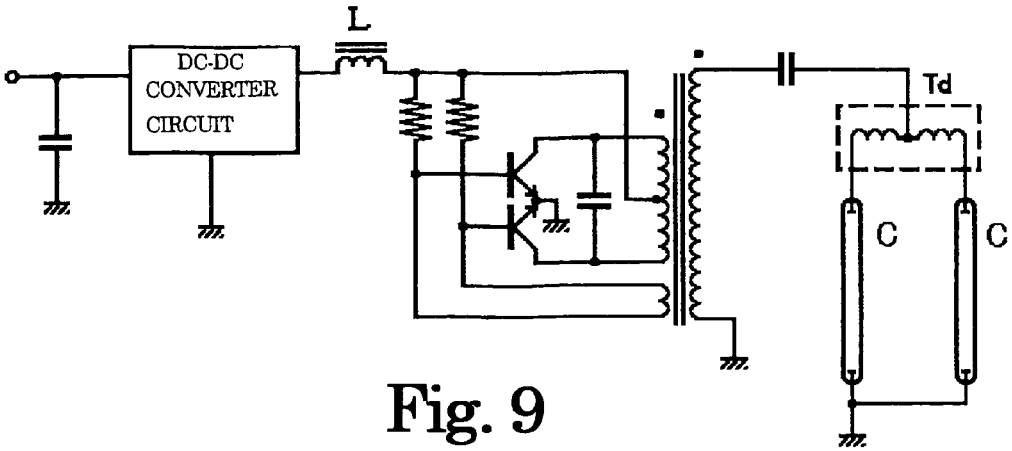
FIG. 9 is a diagram showing a circuit configuration of an example of a transformer and inverter circuit in which a single capacitive ballast is used for a circuit using a conventional non-leakage flux transformer and an output therefrom is shunted.

By the way, a transformer and inverter circuit as shown in FIG. 9 is not excluded either to which is applied the method of using a single capacitive ballast for a circuit using a conventional non-leakage flux transformer and shunting an output therefrom. However, when an output voltage from the transformer is generated according to the conventional design, a high voltage continues to be applied to the secondary winding. Therefore, if the output voltage from the transformer is as it is, it cannot be expected to obtain the effect of suppressing the aging thereof. However, the other advantageous effects are maintained.

Further, if one of the cold-cathode fluorescent lamps C connected to the shunt transformers Td fails to be lighted, there occurs no cancellation of electric currents flowing through the shunt transformers Td, which causes a magnetic flux to be generated in the core. Then, the core is saturated by current flowing through the lighted cold-cathode fluorescent lamp C, whereby a voltage with a high peak value as shown in FIG. 10 is generated at a terminal of the shunt transformer Td on the unlighted side. This makes it possible to start the unlighted cold-cathode fluorescent lamp C by using this voltage.

Figure 13:
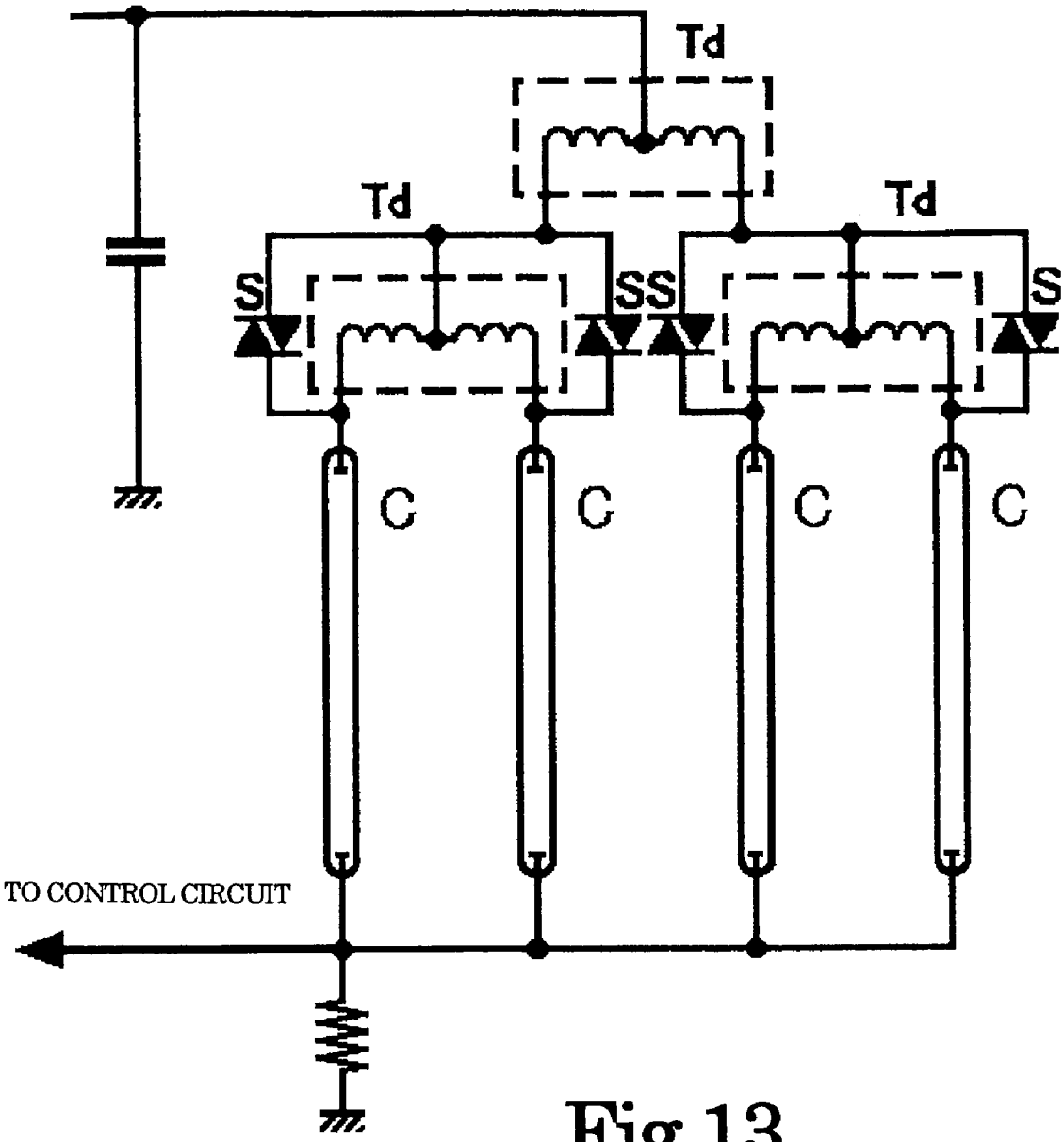
FIG. 13 is a diagram showing a circuit configuration of essential parts of an example in which a diac is arranged in parallel with each winding of a shunt transformer for protection of the winding.

It should be noted that such a voltage with a high peak value sometimes exceeds a voltage necessary for lighting a discharge lamp, and when a discharge lamp has failed to be lighted due to abnormality thereof, the excessively high voltage continues to be generated for a long time period. Therefore, to protect the windings of the shunt transformer, a diac S may be arranged in parallel with each winding. FIG. 13 shows an example of this configuration. In this case, when discharge lamps are normally lighted, a voltage generated in each winding of the shunt transformer is almost zero or approximately several tens of volts. Therefore, so long as the discharge lamps are normally lighted, the balancing operation of the shunt transformer is not adversely affected by the diacs.

Further, when abnormality or wear has occurred in a discharge lamp, the discharged voltage of the discharge lamp becomes high. This increases the voltage generated in each winding of a shunt transformer connected to the discharge lamp. Therefore, by making use of this, it is possible to detect the voltage using a diode Di, as shown in FIGS. 14 and 15.

Figure 14:
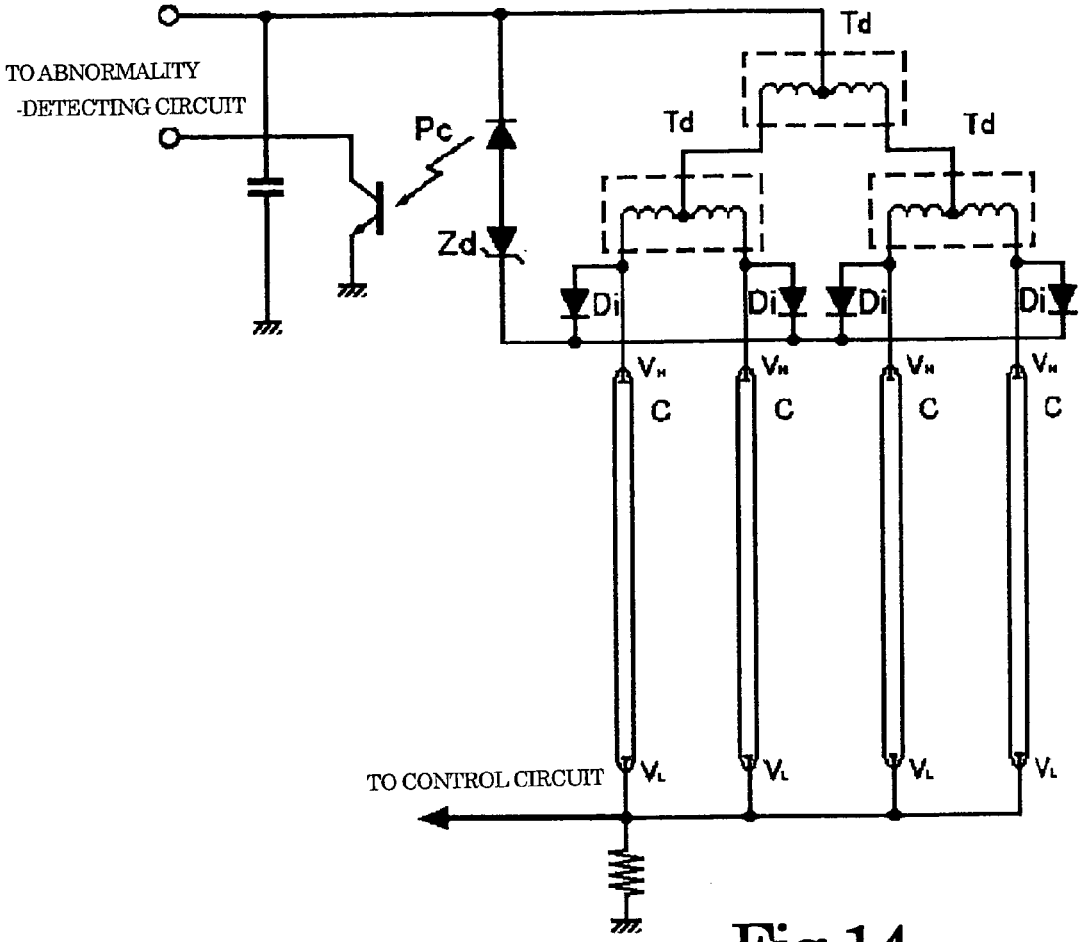
FIG. 14 is a diagram showing a circuit configuration of an example of a circuit provided with the function of detecting abnormality in a discharge lamp.

In an example illustrated in FIG. 14, abnormality of a discharge lamp is detected by utilizing a current which should flow through a diode Pc of a photo coupler when a voltage generated in any of the windings has exceeded the breakdown voltage of an associated zener diode Zd.

Figure 15:
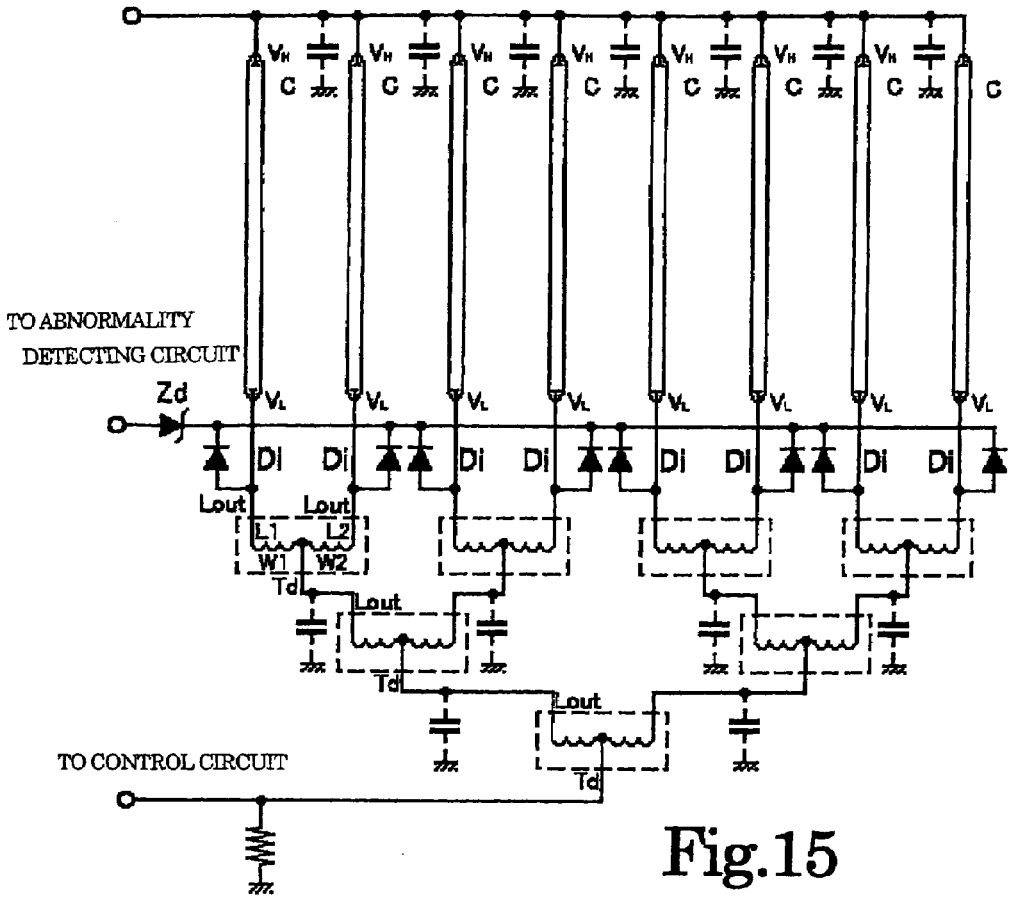
FIG. 15 is a diagram of a circuit configuration showing of another example of a circuit provided with the function of detecting abnormality in a discharge lamp.
Figure 16:
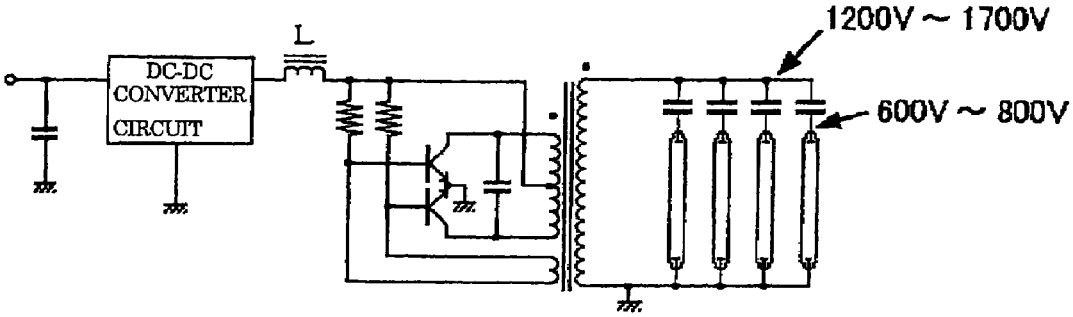
Fig.16 BACKGROUND ART
FIG. 16 is a diagram of a circuit configuration of an example of a conventional multi-lamp lighting circuit.
Figure 17:
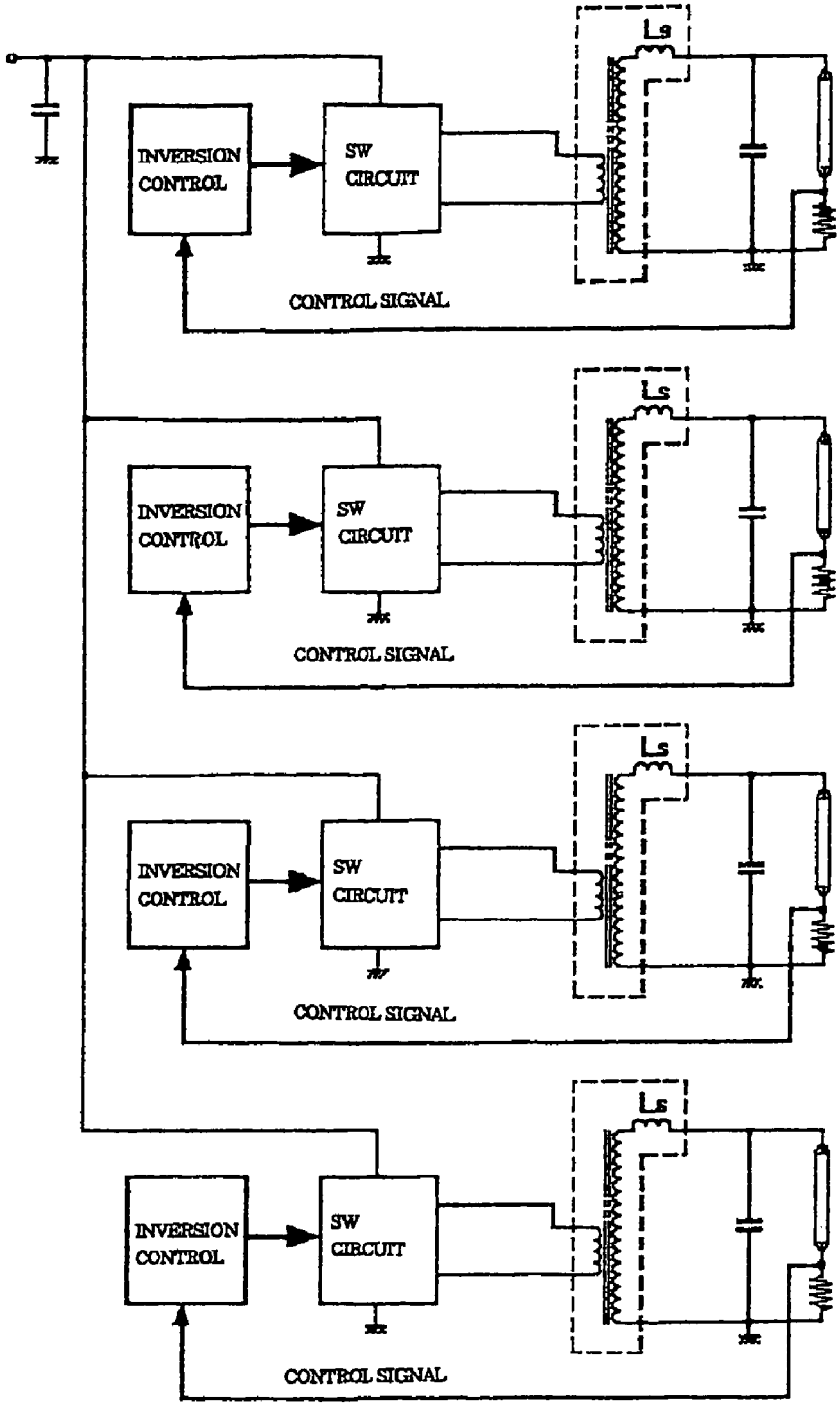
Fig.17 BACKGROUND ART
FIG. 17 is a diagram of a circuit configuration of another example of a conventional multi-lamp lighting circuit.
Figure 18:
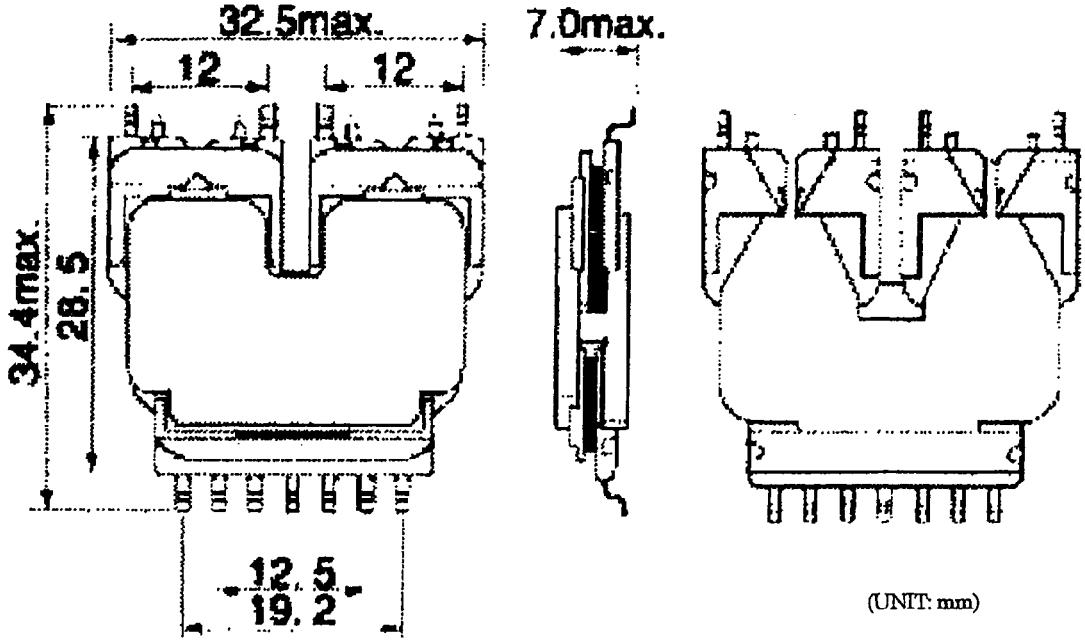
Fig.18 BACKGROUND ART
FIG. 18 is a diagram showing still another example of the prior art, which illustrates the construction of an example of a leakage flux transformer having a plurality of secondary windings with respect to one primary winding.
Figure 19:
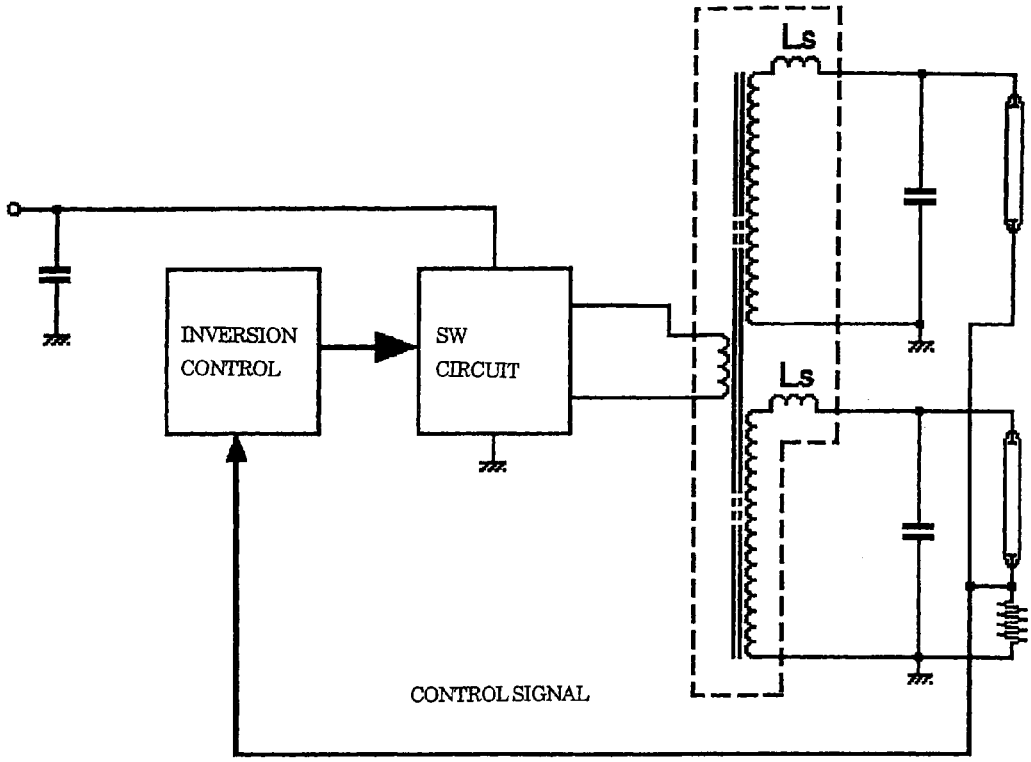
Fig.19 BACKGROUND ART
FIG. 19 is a diagram showing a circuit configuration of an example incorporating the FIG. 18 leakage flux transformer.
Figure 20:
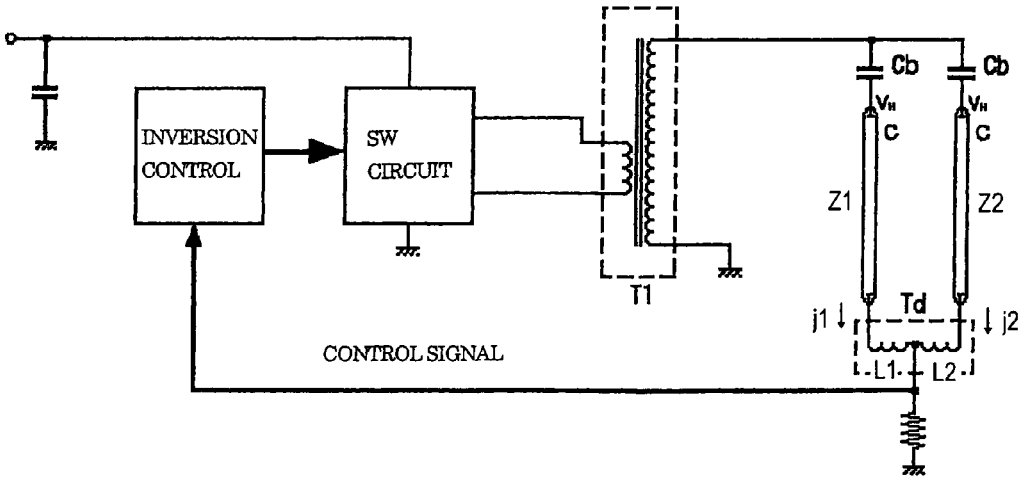
Fig.20 BACKGROUND ART
FIG. 20 is a diagram showing still another example of the prior art, which illustrates a circuit configuration of an example that obtains a major shunting effect by entrusting the effect of lighting cold-cathode fluorescent lamps to the operation of a ballast capacitor connected in series to the cold-cathode fluorescent lamps.

Although this method is simpler than the conventional method, as shown in FIG. 15, if shunt transformers are arranged on a low-voltage side, the voltage generated in each winding of the shunt transformers can be detected more easily.

Further, this arrangement of the shunt transformers makes it possible to decrease an adverse influence by parasitic capacitance occurring in wiring between each shunt transformer to a discharge lamp connected thereto.

For reference purposes, it should be noted that in the specification of the present invention, the term "leakage flux step-up transformer" is intended to mean all transformers which have a sufficiently large value of leakage inductance with respect to a load, but does not exclude transformers formed by connecting core materials in the form of a closed-loop (apparently a so-called closed magnetic circuit transformer but actually a transformer having a capability of a leakage flux transformer).

Although the description of the above embodiment is given based on the examples of using cold-cathode fluorescent lamps, this is not limitative, but the present invention can be applied to discharge lamps in general which require particularly high voltages. For example, the present invention can be applied to a multi-lamp lighting circuit for lighting neon lamps.

Further, although the shunt transformers are arranged on the high-voltage side of the step-up transformer in the above embodiments, this arrangement conforms to the construction of the liquid crystal display backlight with which the embodiments are compatible at the time of the application of the present invention. The effects of balancing lamp currents can be more effective obtained by arranging the shunt transformers on the low-voltage side of the step-up transformer.

[Operation]

Next, a description will be given of the operation of the inverter circuit for discharge lamps for multi-lamp lighting. To light a plurality of hot-cathode lamps using shunt transformers per se is known (Japanese Laid-Open Patent Publication (Kokai) No. SHO 56-54792, Japanese Laid-Open Patent Publication (Kokai) No. SHO 59-108279, Japanese Laid-Open Patent Publication (Kokai) No. HEI 02-117098).

First, the operation of the shunt transformer is described. In a shunt transformer having two windings with the same number of turns, when currents having the same current value are caused to flow through the two windings such that magnetic fluxes generated by the windings are opposed to each other, the generated magnetic fluxes cancel out, whereby a voltage is not generated in each winding of the shunt transformer.

If the output of the step-up transformer having one secondary winding is connected to two cold-cathode fluorescent lamps via a shunt transformer configured as above, lamp currents flowing through the cold-cathode fluorescent lamps connected to the shunt transformer attempts to become equal to each other through the following operation:

If one current flowing through one of the cold-cathode fluorescent lamps is increased, and the other current flowing through the other cold-cathode fluorescent lamps is decreased, magnetic fluxes generated by the shunt transformer according to the present invention are imbalanced to cause a magnetic flux which remains uncancelled. This magnetic flux acts on a cold-cathode fluorescent lamp through which more current is flowing, in a direction of decreasing the current, and acts on a cold-cathode fluorescent lamp through which less electric current is flowing, in a direction of increasing the current, whereby currents flowing through the two cold-cathode fluorescent lamps are caused to be balanced such that the currents are equal to each other.

Although the coupling coefficient between the windings of the shunt transformer used for the above purpose is required to be high to some extent, a new application of the above configuration is possible even if the coupling coefficient is low.

When the coupling coefficient is low, a certain value of the leakage inductance remains. However, the remaining inductance can be applied to a matching circuit between the step-up transformer and the cold-cathode fluorescent lamps, or a waveform shaping circuit. Therefore, it is not necessarily required that the coupling coefficient is very high.

Since the current balancing operation in the present invention is related to the magnitude of mutual inductance between the windings of the shunt transformer, it is only required that the mutual inductance is secured.

Further, when the characteristics of the cold-cathode fluorescent lamps are uniform, currents flowing through the coils of the shunt transformer become equal to each other so that magnetic fluxes cancel out. Hence, no magnetic flux other than the remaining component is generated, which makes it possible to downsize the core and reduce the voltages generated in the shunt transformer to almost zero.

Furthermore, when the step-up transformer is of a leakage flux type, the fact that almost no voltage is generated in the shunt transformer means that the lamp voltage of each cold-cathode fluorescent lamp and the voltage applied to the secondary winding of the leakage flux step-up transformer are equal to each other. For example, if the lamp voltage of the cold-cathode fluorescent lamp is 700 V, the voltage applied to the secondary winding is ideally 700 V as well.

Now, when no current flows through one of the cold-cathode fluorescent lamps connected to the shunt transformer, magnetic fluxes generated by the shunt transformer are imbalanced. However, if the core of the shunt transformer is designed to have a sufficiently small cross-sectional area, and configured such that the core is not saturated when the generated magnetic flows are balanced, and that the core is saturated when the generated magnetic flows are imbalanced, the core is saturated when one of the cold-cathode fluorescent lamps is not lighted, whereby a voltage having a high peak value, as shown in FIG. 10, can be generated at a terminal of the shunt transformer on the unlighted side. This can provide the effect of making it easier to light an unlighted cold-cathode fluorescent lamp.

Further, in the shunt transformer, only a low voltage is generated in each winding when each discharge lamp is normally lighted, whereas when abnormality or an unlighted state has occurred in any of the discharge lamps, a voltage having a high peak value is generated. Therefore, if a diac is arranged in parallel with each winding as shown in FIGS. 13 to 15, windings are not adversely affected by the presence of the diacs when the discharge lamps are normally lighted, whereas when abnormality has occurred in any of the discharge lamps, current flows through a corresponding one of the windings toward the associated diac. Thus, the windings are protected.

Further, when abnormality or an unlighted state has occurred in any of the discharge lamps, or when any of the discharge lamps is worn to change the characteristics thereof, voltages are generated in the windings of the shunt transformer. The voltages, each of which is increased in magnitude according to the degree of wear of the discharge lamp, are collected into one via the diodes Di and applied to an abnormality-detecting circuit for detecting the voltage.

In this case, for example, if zener diodes Zd are arranged in series as required in the detecting circuit, current is caused to flow when an abnormal voltage has exceeded the breakdown voltage of the zener diodes Zd. Therefore, by detecting the electric current, abnormality can be detected in a simplified manner.

Further, since the abnormal voltage is increased in magnitude according to the degree of wear of a discharge lamp, it is possible to know the degree of wear of the discharge lamp, by measuring the abnormal voltage.

As shown in FIG. 14, when the shunt transformers Td are arranged on the high-voltage side, a method of detecting a generated voltage, for example, via a photo coupler is employed.

If the degree of wear of each discharge lamp is to be measured according to the degree of abnormal voltage (in this case, the zener diodes Zd are appropriately removed), it is easier to configure other circuits when the shunt transformers are arranged on the low-voltage side, as shown in FIG. 15.

Further, since the discharge voltage of each cold-cathode fluorescent lamp C is high, currents flowing through the cold-cathode fluorescent lamps C leak to the ground via respective parasitic capacitances Cs. These currents make the currents flowing through the cold-cathode fluorescent lamps C imbalanced.

Even when the shunt transformers Td are arranged on the low-voltage side, there occurs no change in the value itself of parasitic capacitance Cs generated between each winding of each shunt transformer Td and the ground. In this case, however, due to the low voltage, the current which leaks to the ground via the parasitic capacitance Cs becomes almost negligible. As a result, the current-balancing effect of each shunt transformer Td can be effectively utilized.

Differently from a current balancer used in the hot-cathode lamp, in the high-voltage circuit with parasitic capacitance, the current-balancing effect is largely different between the case where the shunt transformers are arranged on the high-voltage side of the cold-cathode fluorescent lamps and the case where the shunt transformers are arranged on the low-voltage side of the cold-cathode fluorescent lamps.

INDUSTRIAL APPLICABILITY

As clearly understood from the above description, the present invention is mainly characterized in that the current flowing through the secondary winding of a leakage flux transformer is shunted such that shunt currents are balanced with each other, and that a voltage generated in each winding can be suppressed to a low level especially when the leakage flux transformer is combined with cold-cathode fluorescent lamps.

The present invention is characterized in that an output voltage of an inverter circuit at a preceding stage can be suppressed to a low level. Even if the inverter circuit at the preceding stage is a circuit other than the inverter circuit described in the embodiments, the present invention can provide the same effect and operation so long as the inverter circuit suffers from problems caused by adverse effect of high voltage.

Therefore, it is possible to realize an inverter circuit for multi-lamp lighting, without loosing the features that there occur almost no aging due to high voltage, that it is possible to largely decrease problems, such as burnout due to interlayer short circuit (layer short circuit/interlayer short circuit) in a secondary winding, and that electrostatic noise is reduced, all of which are advantageous effects obtained by using a leakage flux step-up transformer.

Further, since the cold-cathode fluorescent lamps connected to the shunt transformers according to the present invention are balanced such that currents flowing therethrough become equal to each other, it is possible to dispense with a current control circuit for each cold-cathode fluorescent lamp, but only one control circuit is required. This makes it possible to largely simplify the control circuit.

Furthermore, even if any of a plurality of cold-cathode fluorescent lamps connected according to the present invention have failed to be started and become unlighted, a voltage having a high peak value is applied to the unlighted cold-cathode fluorescent lamp(s) due to the saturating operation of the associated core. This prevents only part of the cold-cathode fluorescent lamps from being unlighted when a plurality of cold-cathode fluorescent lamps are to be lighted, but enables all the cold-cathode fluorescent lamps to be lighted and at the same time currents flowing through the cold-cathode fluorescent lamps to be balanced.

As a result, even in the examples of multi-lamp lighting, shown in FIGS. 2 to 7, the problem of unlighted cold-cathode fluorescent lamps is not caused, and there is no need to take a particular countermeasure to the problem. This makes the lighting circuit very simple and easy to design.

Further, even if the core of a shunt transformer is saturated as described above, the shunt transformer is very small in size, so that the absolute value of the volume of its core is small, generating only a small amount of heat.

Furthermore, when a diac is arranged in parallel with each winding in each shunt transformer, it becomes possible to protect the windings, since the windings are not subjected to any voltage exceeding the withstand voltage thereof.

Further, the circuit for detecting the unlighted state or abnormality of a discharge lamp is made very simple. Particularly when the shunt transformers are arranged on the low-voltage side, the method of detecting abnormality is made still simpler and easier, and is free from influence of parasitic capacitance generated around each shunt transformer. Consequently, the current-balancing effect is made very stable. This effect can be more effectively provided than when the shunt transformers are arranged on the high-voltage side.

The same applies to an inverter circuit using a piezoelectric transformer. By lighting a plurality of cold-cathode fluorescent lamps per circuit, the inverter circuit is capable of multi-lamp lighting, without losing the safety and other advantageous effects of the piezoelectric transformer, which makes it possible to expand the use of the inverter circuit using a piezoelectric transformer.

Further, it is not required to particularly increase the step-up ratio of the piezoelectric transformer, and an output voltage on the secondary side can be suppressed to a low level. This makes it possible to solve the problem that the piezoelectric transformer is damaged, although the inverter circuit is a multi-lamp lighting circuit.

Still further, although in designing the conventional inverter circuit, so as to stabilize currents flowing through cold-cathode fluorescent lamps and make the currents equal to each other, it was necessary at least to design the circuit such that the reactance of each capacitive ballast becomes almost equal to the impedance of an associated cold-cathode fluorescent lamp, due to the capability of shunting current according to the present invention, the reactance of the capacitive ballast can be made small. As a result, the inverter circuit of conventional type can be also designed such that the voltage of a secondary winding is low, whereby it is possible to reduce problems caused by the high voltage of the secondary winding of the transformer.

Figure 21:
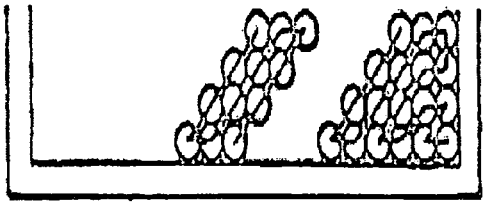
FIG. 21 is a diagram useful in explaining the structure of an oblique winding, which is an example of a winding.
Figure 21:
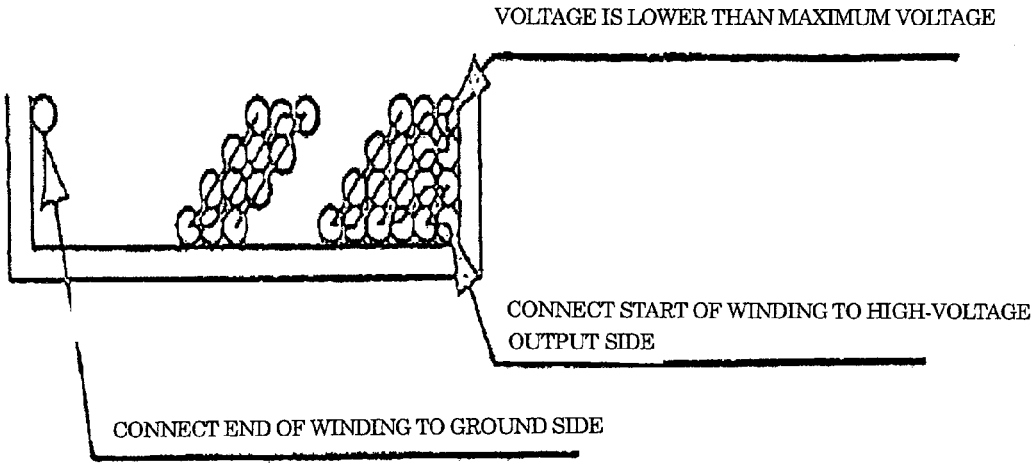

Further, by combining the present invention with an oblique winding method shown in FIG. 21, which is disclosed in U.S. Pat. No. 2002/0140538, Japanese Patent No. 2727461, and Japanese Patent No. 2727462, it becomes possible to increase the self-resonance frequency of the windings, and make the shunt transformer very small in size, as shown in FIGS. 22*a*-22*d*. This is because this winding method has not only the feature that the leakage flux between the windings formed thereby is smaller than that occurring with windings formed by sectional winding, but also the feature that the winding is more excellent in binding property and smaller in the leakage flux within itself. Therefore, it is possible to reduce leakage flux although the shunt transformer has a narrow and deformed shape. As a consequence, it is possible to further reduce the size of the shunt transformer, and thereby further enhance the effect of reduction of heat which is to be generated when the core is saturated.

Figure 22A:
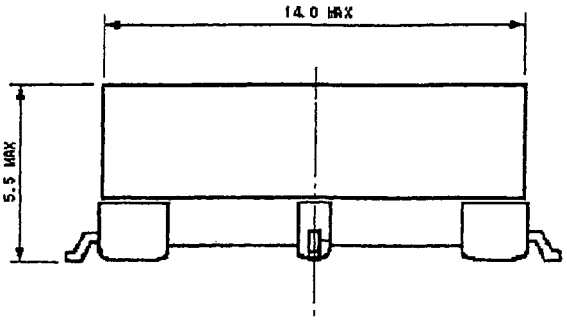
FIGS. 22*a*-22*f* are diagrams which are useful in explaining the construction of a shunt transformer having obliquely-wound windings, according to the present invention.
Figure 22B:
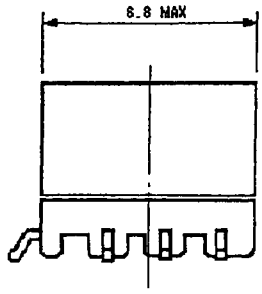
Figure 22C:
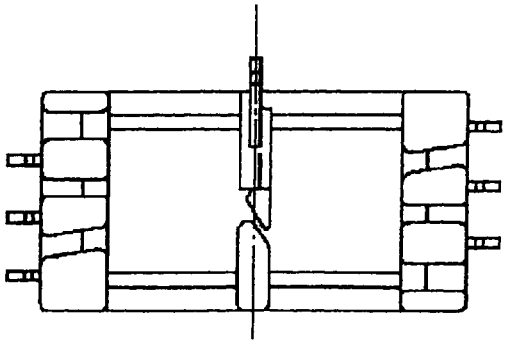
Figure 22D:
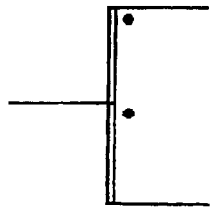
Figure 22E:
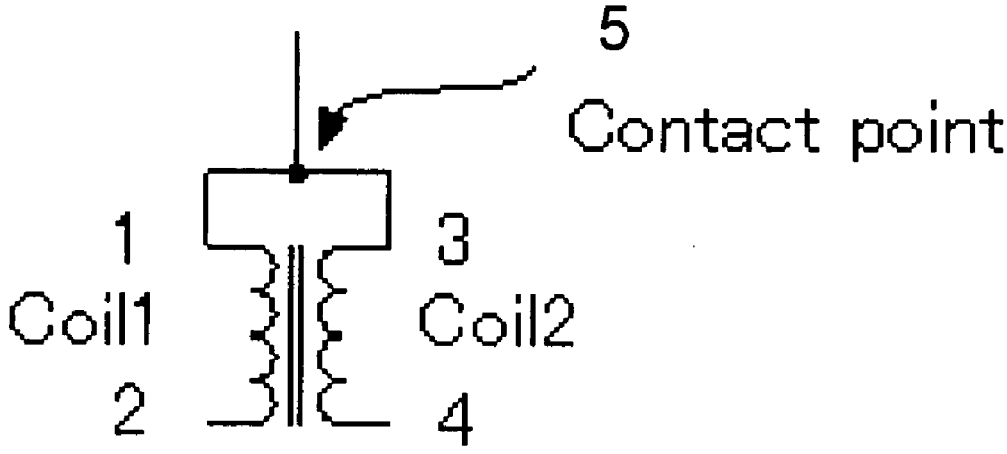
Figure 22F:
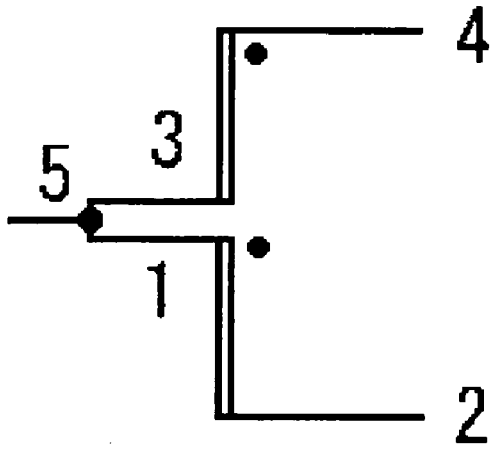

FIGS. 22*e* and 22*f* show diagrams of the shunt transformer implemented in FIGS. 22*a*-22*d*. As shown in FIG. 22*e*, the end 1 of one of the coils and the end 3 of the other coil are connected to a contact point 5, respectively. Each of the other ends 2, 4 of the coils may be connected to each discharge lamp, respectively. However, in an exemplary embodiment utilizing multiple stages of shunt transformers, the each of the other ends 2, 4 of the coils of the shunt transformer may be connected to a contact point 5 of shunt transformers in the next stage, respectively.

Figure 23:
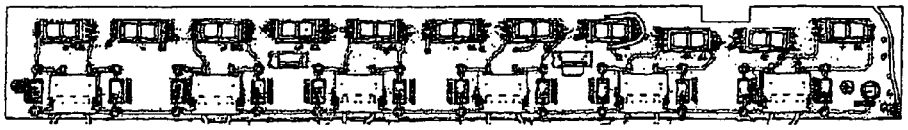
FIG. 23 is a diagram showing an example of a shunt circuit module constructed by the shunt transformers having the obliquely-wound windings, according to an embodiment of the present invention.

FIG. 23 shows a shunt circuit module formed by using the shunt transformers according to the invention. Since the shunt transformers have a shape small in size, which has increased the degree of freedom of layout in the module.

Figure 24:
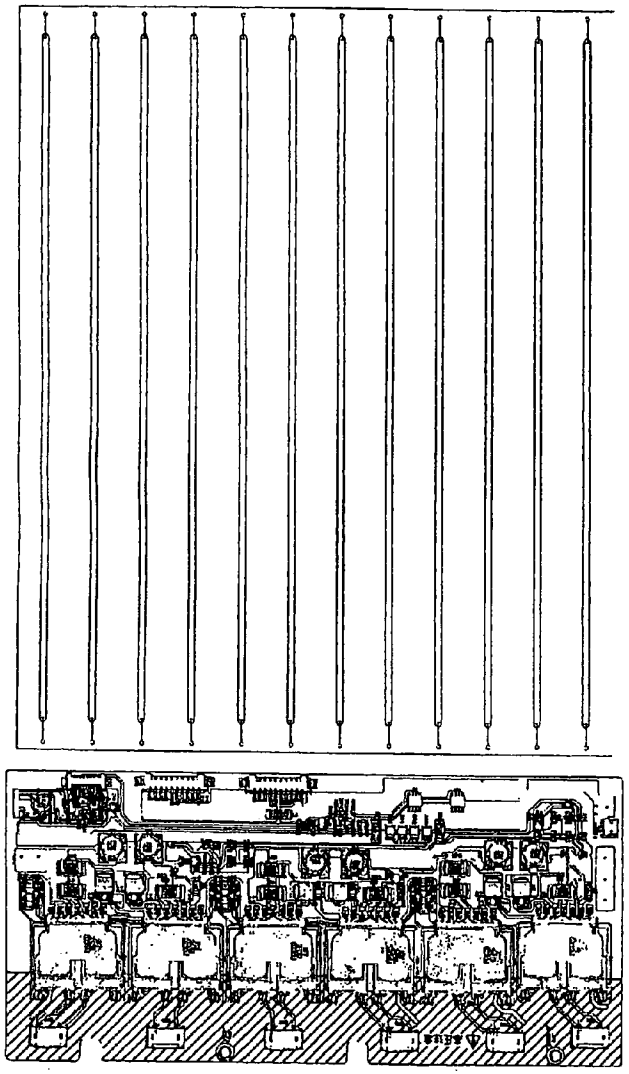
Fig.24 BACKGROUND ART
FIG. 24 is an embodiment diagram showing an example of an inverter section of a conventional multi-lamp surface light source backlight, in which a large number of leakage flux transformers and a large number of control circuits are mounted.
Figure 25:
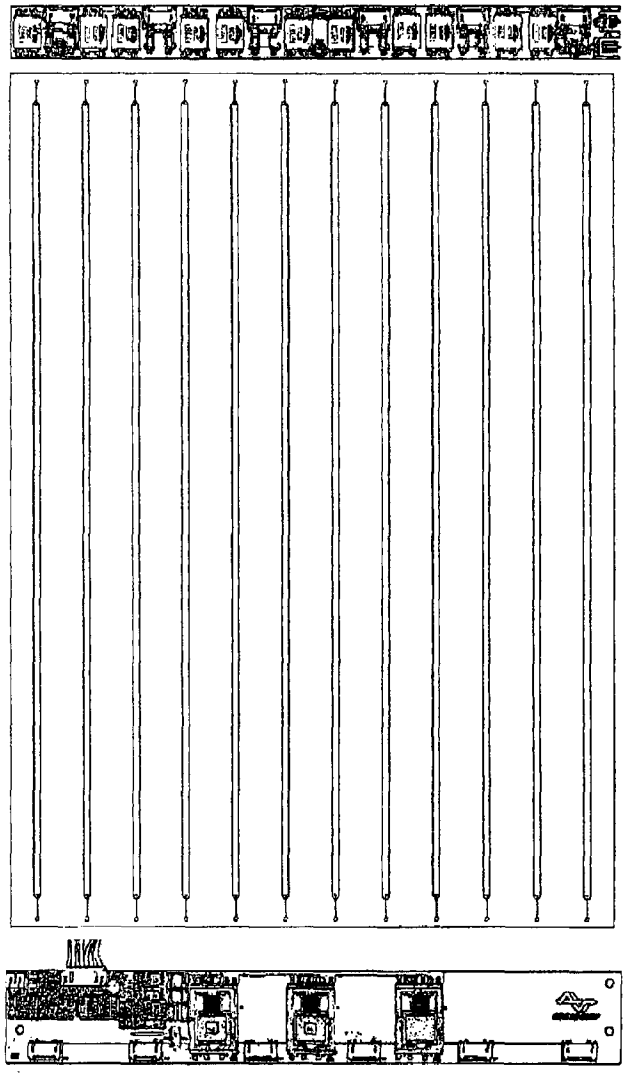
FIG. 25 is an embodiment diagram showing an example of an inverter circuit system of a multi-lamp surface light source backlight having shunt circuits according to the present invention mounted therein, which is comprised of an independent shunt circuit board module on the left side, and an inverter circuit with a small number of leakage flux transformers on the right side, showing that the control circuit is drastically simplified.

FIG. 25 shows an example of a combination of the shunt circuit according to the present invention and a high-efficiency inverter circuit disclosed in Japanese Patent No. 27733817, which is comprised of an independent shunt circuit board module (left), and an inverter circuit (right). The inverter circuit has only one control circuit provided therein, and is made by far simpler in configuration than a conventional inverter circuit (FIG. 24) for a multi-lamp surface light source.

This makes it easy to combine the shunt circuit module with a separately excited resonance circuit, which is a high efficiency inverter circuit the use of which has been conventionally refrained due to high costs, whereby the costs of an inverter circuit system for a multi-lamp surface light source are largely reduced.

As described hereinabove, the use of the shunt circuit module as an independent module different from an inverter circuit board is more effective. The shunt circuit is controlled not as part of the inverter circuit but in a manner combined with a backlight whose voltage-current characteristic (particularly, negative resistance characteristic) is controlled, to thereby form a backlight unit whose characteristics are guaranteed. As a result, the shunt circuit module optimized with respect to the negative resistance characteristic can be constructed easily.

Moreover, based on the idea of regarding the backlight unit in which the shunt circuit module is integrated, as a high-powered cold-cathode fluorescent lamp, and configuring a high-powered inverter circuit in a manner adapted thereto, it is possible to largely downsize and structurization the multi-lamp high-powered backlight system.

What is claimed is:

1. An inverter circuit for discharge lamps for multi-lamp lighting said circuit comprising:

at least two coils connected to a secondary winding of a step-up transformer of the inverter circuit, the at least two coils being arranged and magnetically coupled to each other to form a shunt transformer for shunting current such that magnetic fluxes generated by the at least two coils are opposed to each other to cancel out, the at least two coils being configured to ensure a sufficient inductance for the shunting transformer, discharge lamps connected to said coils, respectively, with currents flowing therethrough being balanced with each other, wherein a large number of discharge lamps are arranged as backlights in a surface light source, an electric conductor being arranged adjacent to said discharge lamps, wherein the discharge lamps arranged as said backlights have a negative resistance characteristic, the inductance of the shunting transformer is sufficient to cause a reactance of the inductance of said shunt transformer to exceed the negative resistance of each of said discharge lamps arranged as said backlights during the current balancing operation, thereby causing each of said discharge lamps to be lit, said reactance being in an operating frequency of the inverter circuit, a shunt circuit is formed by arranging a plurality of shunt transformers such that shunt coils of the plurality of shunt transformers are connected to form a multi-tier structure, shunt coils associated with at least one tier in the multi-tier structure being operably connected to the discharge lamps, and a reactance value of an upper shunt coil is sequentially reduced in comparison with that of a lower shunt coil, whereby a number of turns of shunt coils is progressively reduced.

2. The inverter circuit for discharge lamps for multi-lamp lighting according to claim 1, including a detection circuit comprised of diodes, the detection circuit being configured to detect a voltage generated when any one of said discharge lamps becomes abnormal, wherein one end of each diode in the detection circuit is connected to a junction point at which a respective winding of said shunt transformer is connected to an associated one of said discharge lamps, and the other end of each diode in the detection circuit is connected to a junction point at which the windings of said shunt transformer are connected together.

3. The inverter circuit for discharge lamps for multi-lamp lighting according to claim 1, wherein said two coils of each shunt transformer have obliquely-wound windings.

4. An inverter circuit for discharge lamps for multi-lamp lighting, said circuit comprising:

at least two coils connected to a secondary winding of a step-u transformer of the inverter circuit, the at least two coils being arranged and magnetically coupled to each other to form a shunt transformer for shunting current such that magnetic fluxes generated by the at least two coils are opposed to each other to cancel out, the at least two coils being configured to ensure a sufficient inductance for the shunting transformer, discharge lamps connected to said coils, respectively, with currents flowing therethrough being balanced with each other, wherein a large number of discharge lamps are arranged as backlights in a surface light source, an electric conductor being arranged adjacent to said discharge lamps, wherein the discharge lamps arranged as said backlights have a negative resistance characteristic, the inductance of the shunting transformer is sufficient to cause a reactance of the inductance of said shunt transformer to exceed the negative resistance of each of said discharge lamps arranged as said backlights during the current balancing operation, thereby causing each of said discharge lamps to be lit, said reactance being in an operating frequency of the inverter circuit, a shunt circuit is formed by arranging a plurality of shunt transformers such that said shunt transformers are connected to each other in the form of a tournament tree, whereby shunt transformers are sequentially connected to each other to form a multi-tier structure, two windings of coils of each shunt transformer in the multi-tier structure are wound such that magnetic fluxes generated by said respective windings are opposed to each other, and for each tier in the multi-tier structure, one end of each of said two windings are connected to each other, with each of the other ends of said two windings being connected to the connected ends of two windings of a shunt transformer in a subsequent tier, except for the last tier in the multi-tier structure in which the other ends of said two windings are connected to respective discharge lamps, and when said shunt coils are connected to form a multi-tier structure, a reactance value of an upper shunt coil is sequentially reduced in comparison with that of a lower shunt coil, whereby a number of turns of shunt coils is progressively reduced.

5. The inverter circuit for discharge lamps for multi-lamp lighting according to claim 4, including a detection circuit comprised of diodes, the detection circuit being configured to detect a voltage generated when any one of said discharge lamps become abnormal, wherein one end of each diode in the detection circuit is connected to a junction point at which a respective winding of said shunt transformer and an associated one of said discharge lamps, and the other end of diode in the detection circuit is connected to a junction point at which the windings of the shunt transformer are connected.

6. The inverter circuit for discharge lamps for multi-lamp lighting according to claim 4, wherein said two coils of each shunt transformer have obliquely-wound windings.

* * * * *